US007748926B2

(12) United States Patent
Jurich et al.

(10) Patent No.: US 7,748,926 B2
(45) Date of Patent: Jul. 6, 2010

(54) UTILITIES ACCESS CLOSURE

(75) Inventors: Mark J. Jurich, Pleasanton, CA (US); Rickey G. Swartz, Grass Valley, CA (US); Jon R. Reed, Oakdale, CA (US); Eric C. Freeman, Lodi, CA (US); Wolfgang Ott, Antioch, CA (US); Paul H. Appelblom, Atherton, CA (US); Paul A. Jurich, Pleasanton, CA (US)

(73) Assignee: J.S. Land Management Corporation, Pleasanton, CA (US)

( * ) Notice: Subject to any disclaimer, the term of this patent is extended or adjusted under 35 U.S.C. 154(b) by 212 days.

(21) Appl. No.: 11/610,832

(22) Filed: Dec. 14, 2006

(65) Prior Publication Data

US 2007/0194493 A1 Aug. 23, 2007

Related U.S. Application Data

(62) Division of application No. 10/641,989, filed on Aug. 14, 2003, now Pat. No. 7,163,352.

(51) Int. Cl.
*E04G 21/00* (2006.01)

(52) U.S. Cl. ..... 404/25; 404/72; 249/1; 52/742.14

(58) Field of Classification Search ..... 52/405.3, 52/742.14; 249/1; 404/25, 72
See application file for complete search history.

(56) References Cited

U.S. PATENT DOCUMENTS

| | | | |
|---|---|---|---|
| 3,544,417 | A | 12/1970 | Corzine |
| 3,839,768 | A | 10/1974 | McQuestion |
| 3,920,347 | A | 11/1975 | Sauriol et al. |
| 3,974,599 | A | 8/1976 | Grosh |
| 4,662,777 | A | 5/1987 | Newton |
| 4,726,707 | A | 2/1988 | Newton |
| 4,973,191 | A | 11/1990 | Dannhauser |
| 5,123,776 | A | 6/1992 | Lang et al. |
| 5,312,202 | A | 5/1994 | Newton |
| 5,378,078 | A | 1/1995 | Lewis et al. |
| 5,383,311 | A | 1/1995 | Strickland |

(Continued)

FOREIGN PATENT DOCUMENTS

| | | | |
|---|---|---|---|
| EP | 529178 | A1 | 3/1993 |

(Continued)

*Primary Examiner*—Gary S Hartmann
(74) *Attorney, Agent, or Firm*—Bever, Hoffman & Harms, LLP; E. Eric Hoffman

(57) ABSTRACT

A concrete lid for an in-ground utilities box includes a plastic reinforcement structure filled with concrete. The plastic reinforcement structure includes one or more plastic sidewalls that protect the edges of the lid from damage. The upper and lower surfaces of the lid are exposed concrete (with the exception of the upper and lower edges of the one or more plastic sidewalls). The one or more plastic sidewalls laterally surround a plastic reinforcement grid, which is centrally located between the upper and lower edges of the one or more plastic sidewalls. The one or more plastic sidewalls can be integrally formed with the plastic reinforcement grid. The plastic reinforcement grid reinforces the concrete lid, eliminating the need for separate reinforcement material. Support struts can be used to support the plastic reinforcement grid while wet concrete is being poured into the plastic reinforcing structure.

10 Claims, 22 Drawing Sheets

U.S. PATENT DOCUMENTS 5,486,066 A * 1/1996 Hagenah ..... 404/45
5,511,345 A 4/1996 Jones et al.
5,529,431 A 6/1996 Walsh
5,588,775 A * 12/1996 Hagenah ..... 404/45
5,609,680 A * 3/1997 Kobayashi et al. ..... 106/696
5,611,125 A 3/1997 Williams et al.
5,614,009 A * 3/1997 Kobayashi et al. ..... 106/38.2
5,624,615 A * 4/1997 Sandorff ..... 264/71
5,632,571 A * 5/1997 Mattox ..... 405/19
5,829,215 A 11/1998 Billing
6,267,531 B1 * 7/2001 Clarke ..... 404/34
6,739,797 B1 * 5/2004 Schneider ..... 404/35
7,163,352 B2 * 1/2007 Jurich et al. ..... 404/25

FOREIGN PATENT DOCUMENTS

GB 2232182 12/1990
JP 06049857 2/1994

* cited by examiner

UTILITIES ACCESS CLOSURE

CROSS-REFERENCE TO RELATED APPLICATIONS

The present application is divisional of U.S. patent application Ser. No. 10/641,989 filed Aug. 14, 2003, now allowed, which is a continuation-in-part of provisional U.S. patent application Ser. No. 60/403,999, filed Aug. 15, 2002, which application is incorporated herein by reference in its entirety.

BACKGROUND OF THE INVENTION

1. Field of the Invention

The present invention relates to closures for underground housings having surface access openings, and more particularly, to lids or caps for such openings.

2. Description of the Related Art

Utilities of various types are commonly buried underground. Such utilities include, for example, water, sewer, natural gas, telephone, cable television, irrigation, electric service, security and fire alarm service. Underground utilities commonly employ an access portal to allow service personnel to access the utilities for maintenance and meter reading. This access portal typically includes a pre-cast concrete box that is buried underground. Utility devices, such as valve mains, meters and wire connectors, are located within the concrete box. The box includes an opening through which the utility devices are accessed. When the box is not being accessed, the opening is covered by a lid. The lid and box are located such that the lid is flush, or nearly flush, with the level of the surrounding ground. The lid is typically made of pre-cast concrete or composite resin. The lid can include a lip that is shaped to engage the opening in the box. Alternatively, the opening of the box can be shaped to receive the lid, which does not have a lip.

A common configuration is a lid having tapered sidewalls, and a box having an opening with corresponding tapered sidewalls. In this configuration, the lid easily slides into the opening of the box and fixes itself firmly in place as the tapering sidewalls of the lid engage the tapering sidewalls of the opening. This design is relatively inexpensive to form and fairly robust, compared with more complicated closures.

While the concrete lids and boxes are quite strong, these lids tend to be heavy, and repeated opening of the box causes wear or damage. Operators, in opening and closing the box, tend to be careless in handling the lid. As the edges of the lid strike the edges of the box opening (or the ground), the concrete can chip or fracture on either one or both of the lid and the box. Over time, the lid may sustain too much damage to function properly, thereby requiring replacement of the lid. The box may also eventually reach a point where it must be replaced, as a result of damage to the opening therein. Replacement of the box can be costly and labor intensive, requiring the breaking of pavement in those cases where the box is under pavement. At the very least, the box must be excavated and replaced with a new box.

Additionally, in environments where freezing occurs, water may freeze between the lip of the sidewalls of the lid and the sidewalls of the box opening. In such an event, it is extremely difficult to remove the lid from the box. In extreme cases, the effort required to remove the lid from the box may be sufficient to destroy the lid.

Concrete lids are typically formed using a rubber mat and a sturdy aluminum dryer, which has a thickness on the order of 1 inch or more. FIG. 1 is a cross sectional view of an aluminum dryer 101, which is fitted into a corresponding rubber mat 102. Rubber mat 102 is placed flat on a platform 103. The upper surface of the rubber mat includes various raised sections 104, which create patterns and graphics on the upper surface of the lid. The outer edges of aluminum dryer 101 engage ridges on rubber mat 102, such that aluminum dryer 101 is held on rubber mat 102.

When creating lids, a reinforcing structure 105 can be set on rubber mat 102, within the perimeter of aluminum dryer 101. Reinforcing structure 105 includes a welded wire rack 106, which is supported by a set of four wheels 107. Wheels 107 are required to support wire rack 106 when wet concrete is poured into aluminum dryer 101. Reinforcing structure 105 is free-floating within aluminum dryer 101.

After aluminum dryer 101, rubber mat 102 and reinforcing structure 105 have been assembled, wet concrete 110 is poured into the upper opening of aluminum dryer 101 (and onto rubber mat 102). The concrete 110 is leveled off at the upper surface of aluminum dryer 101. The concrete 110 is then allowed to dry. When the concrete 110 has sufficiently set, rubber mat 102 is peeled off and the concrete 110, and embedded reinforcing structure 105, are removed from aluminum dryer 101 (typically by hammer). The removed concrete 110 and reinforcing structure 105 form a concrete lid. Aluminum dryer 101 is then cleaned, typically by scraping off any excess dried concrete. The process is then repeated, reusing aluminum dryer 101 and rubber mat 102.

This process has several disadvantages. First, as described above, the process is labor intensive. In addition, the number of lids that can be produced at a time is limited by the number of aluminum dryers. The aluminum dryers are expensive and take up significant storage space, thus providing a practical limitation on the number of aluminum dryers that can be used. Moreover, the rubber mats shrink over time, thereby resulting in irregular edges around the upper surface of the resulting lids. The rubber mats primarily shrink at the edges where the rubber mat contacts the aluminum dryer. The different coefficients of expansion/contraction between rubber mat 102 and aluminum dryer 101 contribute to this shrinkage. The rubber mat shrinkage can also cause the patterns/printing formed on the upper surface of the lid to be raised or recessed with respect to the upper surface of the lid, thereby creating a tripping hazard. Eventually, the rubber mats degrade to a point where they must be replaced. In addition, reinforcing structure 105 is relatively expensive, as this is a separate multi-piece element that must be manually inserted into aluminum dryer 101. Finally, the edges of the resulting lid are concrete. As a result, these edges are susceptible to chipping and cracking when the lid is inserted and removed from the concrete box. Moreover, these edges can chip or crack at the time of manufacture, thereby causing these lids to be thrown away and raising the cost of production.

Some concrete lids have been created using a sheet metal form. FIG. 2 is a view of a conventional sheet metal form 201, which is fitted into a corresponding rubber mat 202. Rubber mat 202 is placed flat on a platform 203. Again, the upper surface of rubber mat 202 includes various raised sections 204, which create patterns and graphics on the upper surface of the lid. The outer edges of metal form 201 engage ridges on rubber mat 202, such that metal form 201 is held on rubber mat 202.

Metal form 201 is significantly thinner than aluminum dryer 101. For example, metal form 201 may be formed from a steel galvanized sheet metal having a thickness of about 1/16 inch. Metal form 201 includes tapered sidewalls 201A and a lattice structure 201B continuous with the sidewalls 201A.

After metal form 201 and rubber mat 202 have been assembled, wet concrete 210 is poured through the lattice structure 201B into metal form 201 (and onto rubber mat 202). The concrete 210 is leveled off at the upper surface of metal form 201. The concrete 210 is then allowed to dry. When the concrete 210 has sufficiently set, rubber mat 202 is peeled off, thereby completing fabrication of the lid. Metal form 201 remains intact on the completed lid.

This process also has several disadvantages. First, metal form 201 is created using a five-step process, with one of these steps requiring the use of a 30-ton press. As a result, metal form 201 is relatively difficult and expensive to fabricate (on the order of $3.25 per form). Moreover, because metal form 201 is not as heavy as aluminum dryer 101, the wet concrete tends to displace metal form 201 on rubber mat 202, such that some concrete seeps under the metal form, as illustrated at locations 211 and 212. This concrete readily chips, thereby contributing to an irregular edge at the upper surface of the lid. This problem worsens as rubber mat 202 shrinks over time. In addition, lattice structure 201B, which functions to maintain the shape of metal form 201 during the concrete pour (and drying), does not provide any significant reinforcement to the resulting concrete lid (largely because this lattice structure 201B is located at the bottom of the lid). Moreover, the portions of concrete 210 immediately adjacent to lattice structure 201B are susceptible to chipping.

Lids have also been made from composite resin. Composite resin lids are lighter and less susceptible to chipping and cracking than concrete lids. However, composite resin lids are significantly more expensive than concrete lids. More specifically, a composite resin lids will typically be two to three times more expensive than a concrete lid of similar size. Moreover, composite resin lids are a petroleum-based product. Thus, the cost of composite resin lids is ultimately based on the price of petroleum. In addition, composite resin lids have a tendency to discolor in response to extended exposure to the sun.

It would therefore be desirable to have a low-cost, durable lid for utility closures that overcomes the above-described deficiencies of the prior art.

SUMMARY

Accordingly, the present invention provides an improved lid for in-ground utility boxes or vaults. In accordance with one embodiment, the lid includes a concrete core, and one or more plastic sidewalls laterally surrounding the concrete core. The one or more plastic sidewalls can have, for example, a tapered cylindrical shape or a rectangular shape. The concrete core has at least an upper surface or a lower surface exposed through the one or more plastic sidewalls. In a preferred embodiment, the concrete core has both an upper surface and a lower surface exposed through the one or more plastic sidewalls. The plastic sidewalls provide both reinforcement and a chip-resistant edge to the concrete lid.

The lid can further include a plastic reinforcement grid coupled to, and laterally surrounded by, the one or more plastic sidewalls. In accordance with one embodiment, the plastic reinforcement grid is coupled to the one or more plastic sidewalls about halfway between the upper and lower edges of the plastic sidewalls. The plastic reinforcement grid is entirely surrounded by concrete in the finished lid, thereby providing structural reinforcement to the concrete lid. In one embodiment, the one or more plastic sidewalls and the reinforcement grid are formed as a single integral unit. For example, the plastic sidewalls and reinforcement grid can be formed by injection-molded polypropylene.

A mold can be used to pattern various elements in the upper concrete surface of the lid, including a non-slip texture, nomenclature identifying the lid, and lift holes. The lift holes may extend entirely through the concrete core and the reinforcement grid. Alternately, one or more lift rods can be coupled to the reinforcement grid, and the lift holes may be located to expose the one or more lift rods from the upper surface of the concrete core. The lift rods can be coupled to a lower surface of the reinforcement grid, such that the reinforcement grid is located between the lift rods and the upper surface of the concrete core. In this case, the reinforcement grid provides additional support for the lift rods.

In accordance with another embodiment, the upper edge of the plastic sidewalls has a rolled edge, thereby improving the structural strength of the plastic reinforcement structure. Gussets can also be formed along the plastic sidewalls to improve the strength of the plastic reinforcement structure.

For larger concrete lids, support struts can be added to prevent deformation of the plastic reinforcement grid. In accordance with one embodiment, the support struts extend from the plastic reinforcement grid to a location that co-planar with the upper edge of the plastic sidewalls. These support struts maintain the position of the plastic reinforcement grid when wet concrete is being poured into the plastic reinforcement structure. The support struts can be formed integrally with the plastic reinforcement grid.

In accordance with another embodiment, a nameplate mounting structure is coupled to the plastic reinforcement grid. The nameplate mounting structure has a mounting platform, with one or more connector elements exposed at the upper surface of the concrete core. A nameplate can be coupled to the connector elements of the nameplate mounting structure, thereby efficiently labeling the concrete lid. The various elements are sized such that the nameplate is substantially co-planar with the upper surface of the concrete core. In a preferred embodiment both the nameplate mounting structure and the nameplate are plastic.

The present invention also includes various methods for forming the concrete lid of the present invention. One such method includes the steps of: (1) coupling a plastic reinforcing structure to a mold, wherein a first edge of the plastic reinforcing structure engages the mold, (2) filling the plastic reinforcing structure with concrete, wherein the concrete is contained by the plastic reinforcing structure and the mold, (3) curing the concrete, thereby creating cured concrete that bonds to the plastic reinforcing structure, and (4) removing the mold from the plastic reinforcing structure and the cured concrete.

The step of filling the plastic reinforcement structure can further include pouring wet concrete into the plastic reinforcement structure, wherein the wet concrete passes through openings in a plastic reinforcement grid that is integrally formed with, and centrally located within, the plastic reinforcement structure.

The method can further include supporting the plastic reinforcement grid with one or more support struts that extend between the plastic reinforcement grid and the mold.

The method can further include connecting one or more lift rods to the plastic reinforcement grid, and exposing portions of the one or more lift rods through the concrete using the mold. The lift rods are positioned such that the plastic reinforcement grid is located between the lift rods and the mold.

The method can further include coupling a nameplate mounting structure to the plastic reinforcement grid, wherein a first portion of the nameplate mounting structure contacts the mold, such that the concrete does not reach the first portion of the nameplate mounting structure. A nameplate can then be attached to the first portion of the nameplate mounting structure, after removing the mold. Alternately, the nameplate can be attached before the concrete is poured.

In accordance with another embodiment, the invention can include a plastic reinforcement structure for a concrete lid. In this embodiment, the plastic reinforcement structure includes one or more plastic sidewalls laterally surrounding a region configured to receive concrete for forming the concrete lid, and a plastic reinforcement grid formed integrally with the one or more plastic sidewalls, the plastic reinforcement grid being circumscribed by the one or more plastic sidewalls and lying in a plane that is centrally located between an upper edge of the one or more plastic sidewalls and a lower edge of the one or more plastic sidewalls.

The present invention will be more fully understood in view of the following description and drawings.

DETAILED DESCRIPTION

Figure 1:
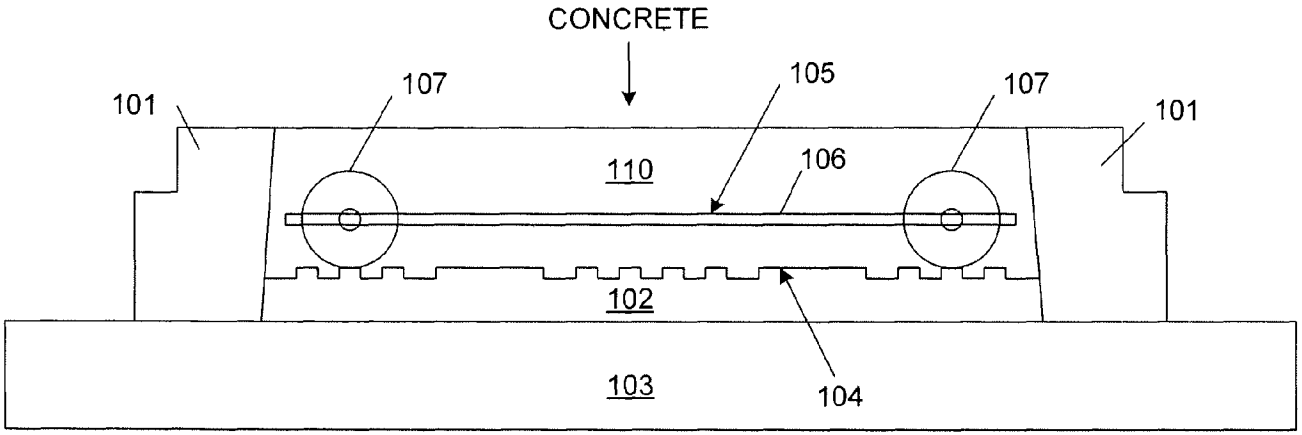
FIG. 1 (PRIOR ART)
FIG. 1 is a cross sectional view of a conventional concrete lid during fabrication.
Figure 2:
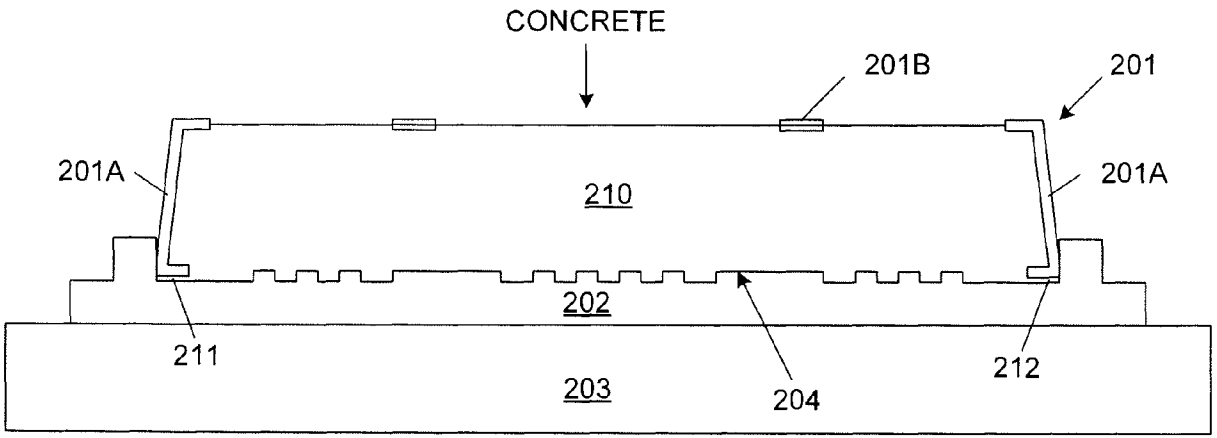
FIG. 2 (PRIOR ART)
FIG. 2 is a cross sectional view of another conventional concrete lid during fabrication.
Figure 3:
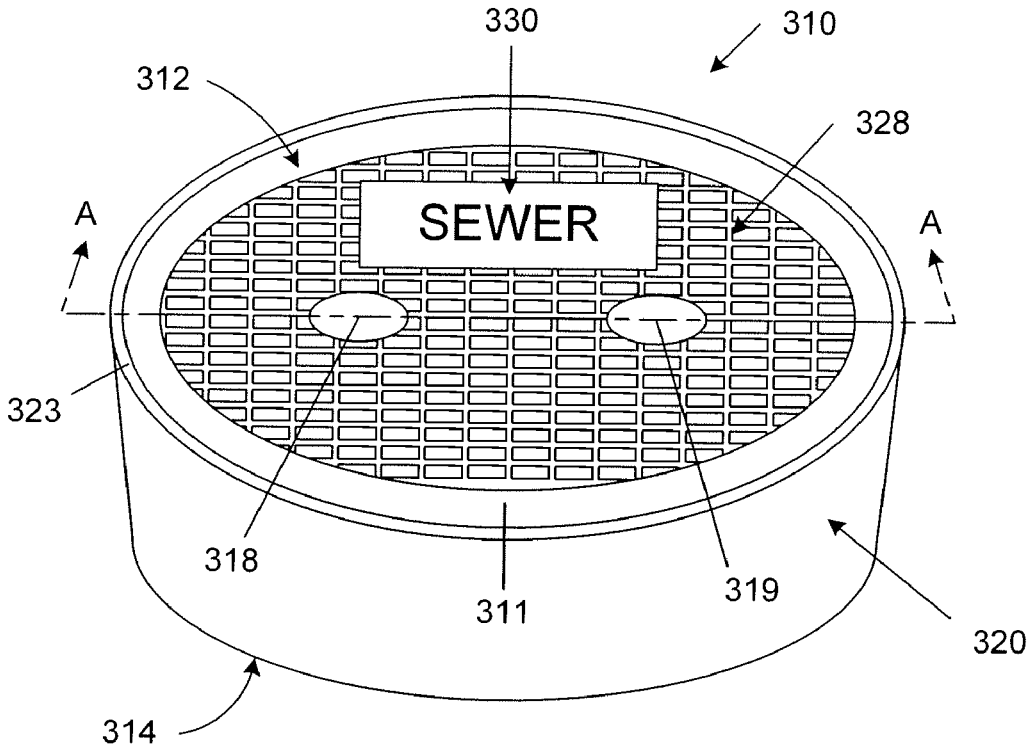
FIG. 3 is an isometric view of a concrete lid in accordance with one embodiment of the present invention.
Figure 4:
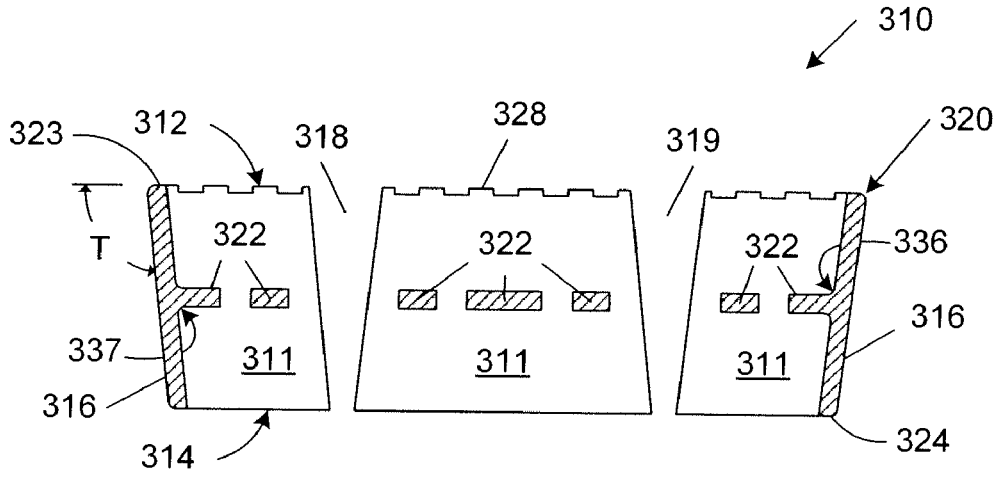
FIG. 4 is a cross sectional view of the concrete lid of FIG. 3 along section line A-A of FIG. 3.

FIG. 3 is an isometric view of a utilities access lid 310, in accordance with one embodiment of the present invention. FIG. 4 is a cross sectional view of lid 310 along section line A-A of FIG. 3. Lid 310 may also be referred to as a closure, a cover, a cap, or another similar term. In accordance with the present invention, lid 310 includes a concrete core 311, which is surrounded and reinforced by a unitary plastic ring structure 320.

As shown in FIG. 3, lid 310 is disc shaped, having a round plan view profile. Thus, lid 310 includes a circular top surface 312 and a mutually opposing circular bottom surface 314. The top surface 312 and the bottom surface 314 are substantially parallel to one another. Substantially all of the top surface 312 of lid 310 is exposed concrete, with the exception of the upper edge 323 of plastic ring structure 320, which encircles the exposed concrete at top surface 312. Similarly, substantially all of the bottom surface 314 of lid 310 is exposed concrete, with the exception of the lower edge 324 of plastic ring structure 320, which encircles the exposed concrete at bottom surface 314.

The top surface 312 includes a textured concrete finish 328 to provide a non-skid surface. The top surface 312 further includes nomenclature 330, indicating the type of utility found in the associated box. In the present embodiment, nomenclature 330 is formed by patterning the concrete in the top surface 312. However, as described in more detail below, nomenclature 330 can also be implemented by a plastic structure in other embodiments. Optional lift holes 318-319 extend through lid 310 between top surface 312 and bottom surface 314. These lift holes 318-319 facilitate the removal of lid 310 from an associated concrete box.

As illustrated in FIG. 4, ring structure 320 includes a circumscribing sidewall 316 and a reinforcement grid 322. Reinforcement grid 322 is integrally formed with the circumscribing sidewall 316. In the described embodiment, ring structure 320 is molded from a plastic material. In accordance with a preferred embodiment, reinforcement ring 320 is molded from polypropylene plastic, preferably with an ultraviolet inhibitor to retard damage due to sunlight. Polypropylene is chosen because of its strength and impact characteristics. In this embodiment, sidewall 316 and reinforcement grid 322 each have a thickness in the range of about 1/16 to 1/8 of an inch, or more specifically about 3/32 inch. In other embodiments, reinforcement ring 320 may be made from any plastic material having the appropriate strength and impact resistance characteristics to meet the functional requirements described below.

Reinforcement grid 322 is centrally located along the sidewall 316, between the top surface 312 and the bottom surface 314 of lid 310. In a particular embodiment, reinforcement grid 322 is located half way between the top surface 312 and bottom surface 314 plus or minus 20-25%. In another embodiment, reinforcement grid 322 is located half way between the top surface 312 and bottom surface 314 plus or minus 10%. In one application, lid 310 has an outer diameter of approximately 8.9 inches at the upper edge 323 of ring structure 320, and an outer diameter of approximately 8.65 inches at the lower edge 324 or ring structure 320. The height of lid 310 is approximately 2 inches. The circumscribing sidewall 316 of lid 10 tapers from the top surface 312 to the bottom surface 314 at an angle T. This angle T is preferably greater than 90°. According to the embodiment shown, the angle T is 93.5°, and may be formed to be in the range of 93° to 94°. At the extremes, angle T is preferably formed in the range of about 92° to about 96°. As described in more detail below, the dimensions of ring structure 320 precisely determine the dimensions of lid 310.

In accordance with another embodiment of the present invention, reinforcement grid 322 is located along the lower half of lid 310, closer to bottom surface 314 (but not at the bottom surface 314). This location is selected because for a stress load is applied onto the upper surface of lid 310, the bottom of lid 310 is the most likely to break or give way. In one embodiment, reinforcement grid 322 is located approximately at a height from bottom surface 314 that is equal to about 37.5 percent of the height of lid 310, plus or minus 30%.

Figure 5:
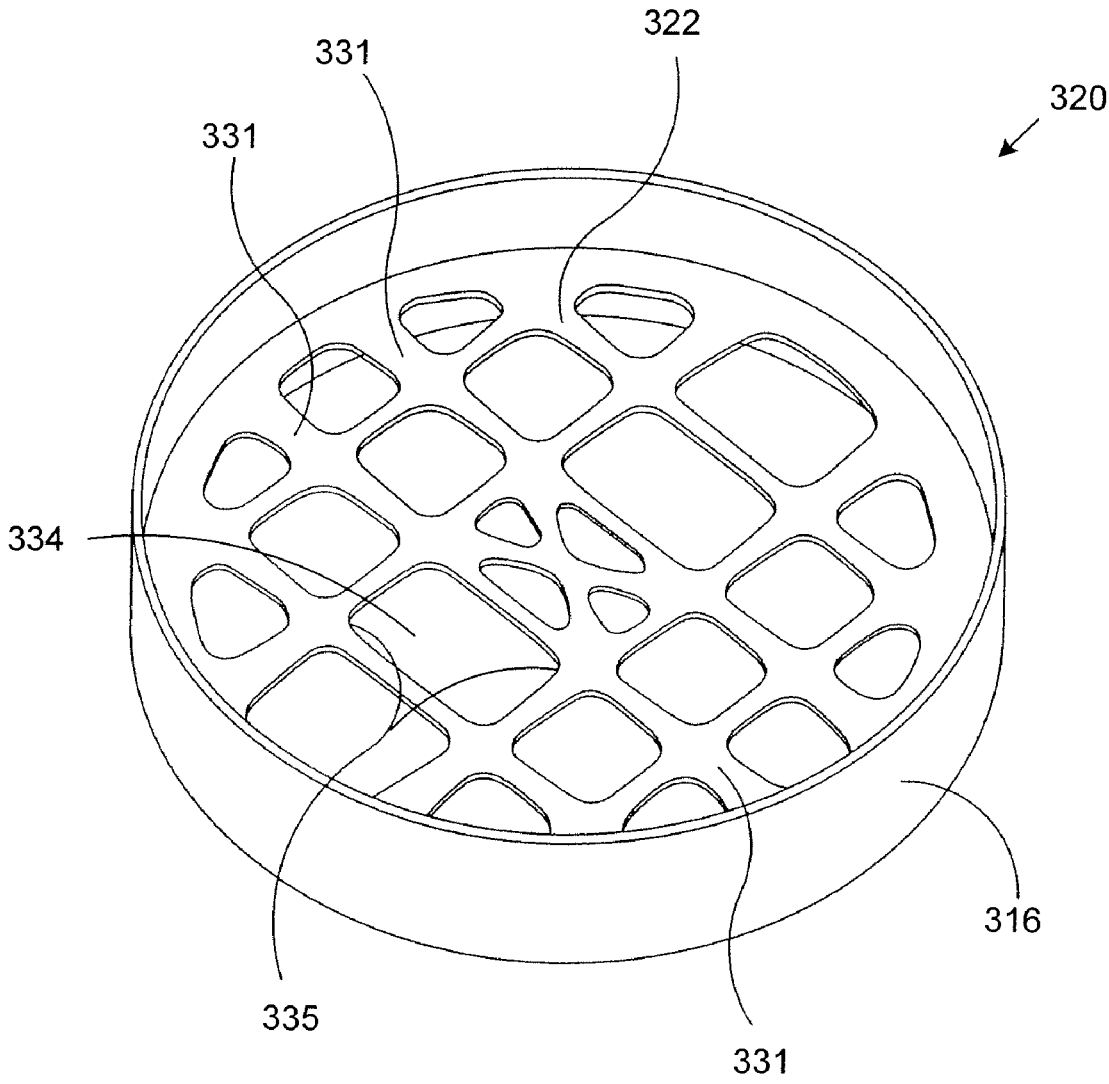
FIG. 5 is an isometric view of a plastic ring structure according to an embodiment of the invention.

FIG. 5 is an isometric view of ring structure 320 in accordance with one embodiment of the present invention. FIG. 5 clearly shows the lattice structure of reinforcement grid 322, as well as the unitary structure of circumscribing sidewall 316 and reinforcement grid 322. Circumscribing sidewall 316 and reinforcement grid 322 provide reinforcement for the concrete core 311, thus eliminating the need for rebar or wire reinforcement in lid 310. Reinforcement grid 322 is defined by reinforcing members (e.g., reinforcing members 331). The openings in reinforcement grid 322 have curved corners to reduce stress at those points and increase the life of reinforcement grid 322. For example, opening 334 in reinforcement grid 322 has curved corners 335. The locations where the circumscribing sidewall 316 meet reinforcement grid 322 also exhibit curved edges (e.g., curved edges 336-337, FIG. 4), thereby reducing stress at these edges. The upper edge 323 and the lower edge 324 are also curved, as illustrated in FIG. 3. The openings of the lattice structure of reinforcement grid 322 are large enough to permit the passage of wet concrete. These openings are also located to allow the formation of lift holes 318-319 through these openings, as shown in the cross sectional view of FIG. 4.

Reinforcement ring structure 320 provides significant protection to lid 310. Thus, lid 310 can be dropped from heights that would cause cracking or chipping of a conventional concrete lid, without adverse results.

Figure 6:
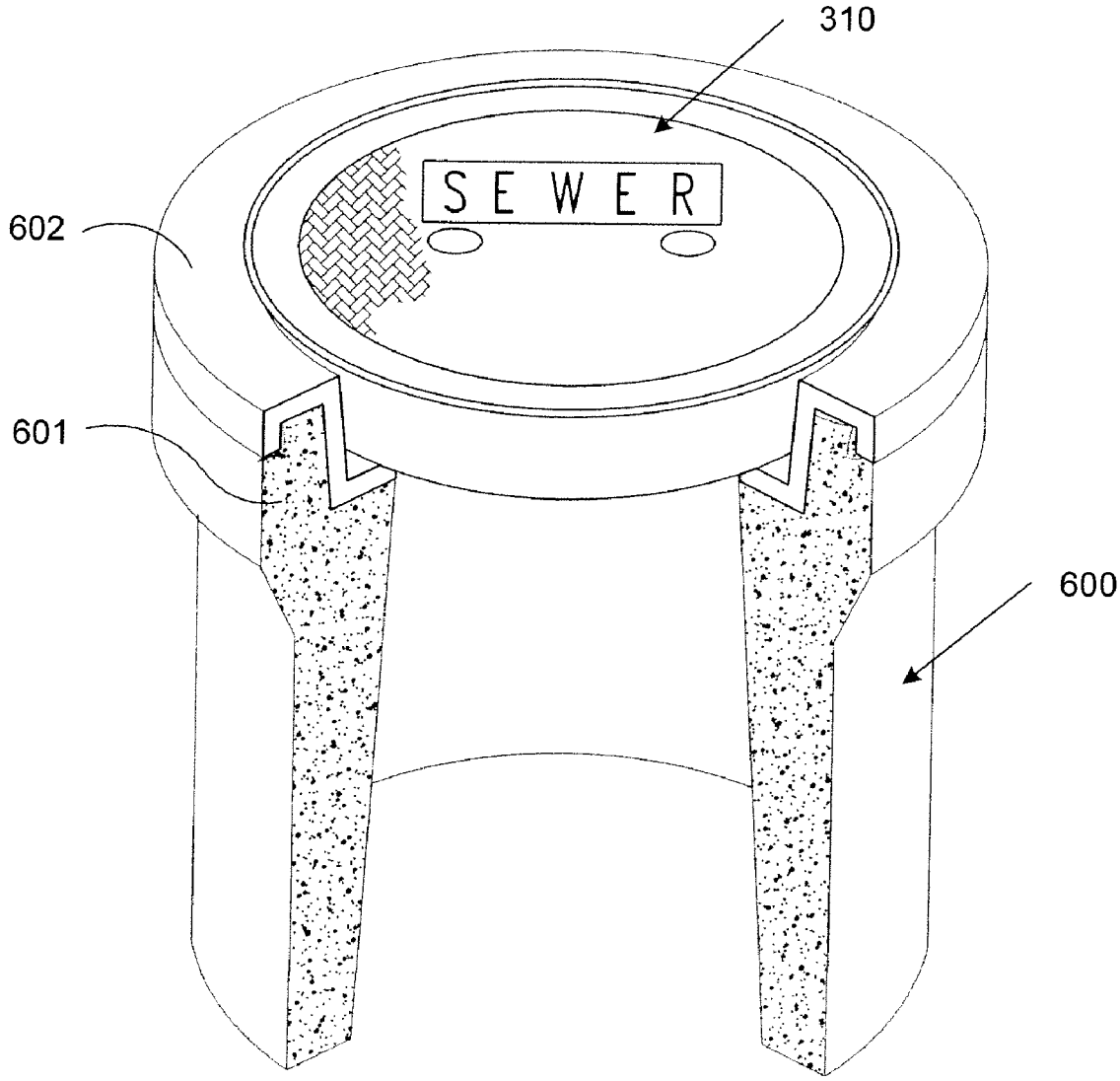
FIG. 6 is an isometric view of a utilities box and lid in accordance with one embodiment of the present invention.

FIG. 6 is an isometric view of lid 310 in place on a cylindrical pre-cast concrete box 600, with a cutaway view to show the junction of lid 310 with box 600. In this embodiment, box 600 includes a plastic cap 602 cast into an upper rim 601 of box 600, such that cap 602 is non-removable. Note that plastic cap 602 can also be fitted onto upper rim 601 after box 600 has been cast. Cap 602 is formed from material similar or identical to that of ring structure 320, and serves to protect the upper surface of box 600.

Ring structure 320 prevents chipping and cracking of lid 310 and of utilities box 600 as these elements come into contact during normal handling of lid 310. Such chipping and cracking is prevented because the plastic of ring structure 320 contacts the plastic of cap 602. Thus, there is no concrete-to-concrete contact when removing and replacing lid 310. Note that even if cap 602 were not present on box 600, the plastic of ring structure 320 would prevent concrete-to-concrete contact at the sidewalls of lid 310. As a result, lid 310 will not only last longer, reducing the expense of frequent replacement, but will also protect box 600, obviating the need for the more expensive replacement of utilities box 600. In cold environments, the smooth surface of ring structure 320 helps prevent ice from locking lid 310 in the opening of box 600.

Figure 7:
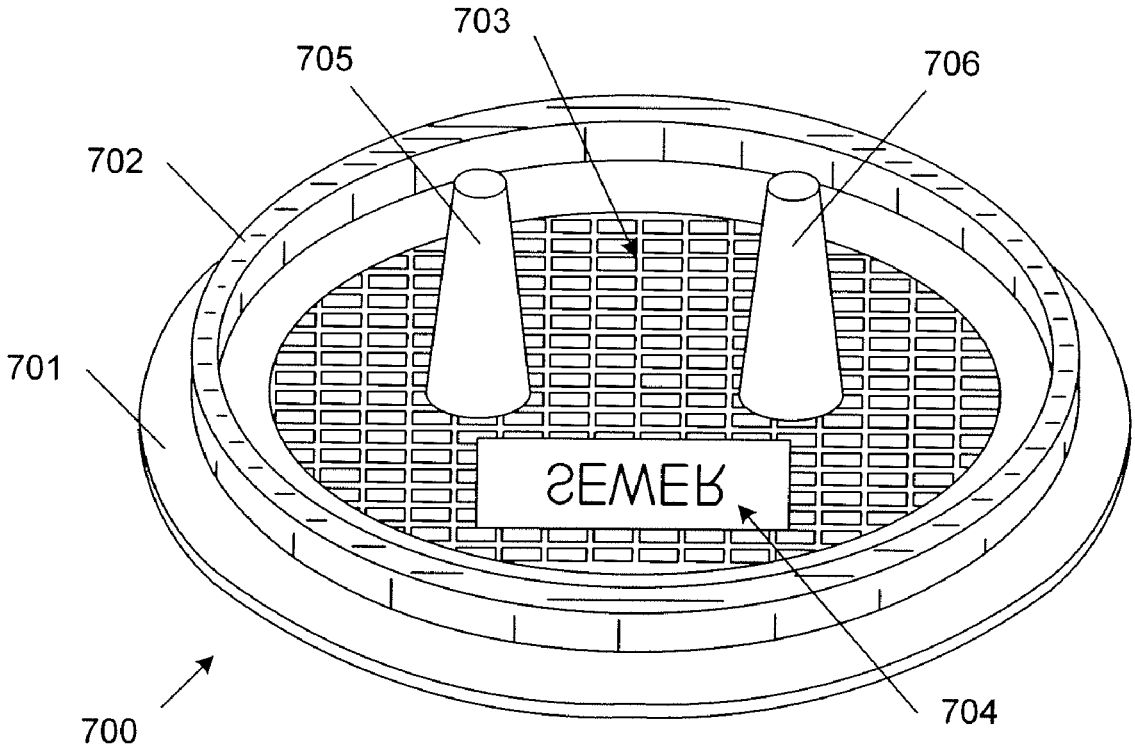
FIG. 7 is an isometric view of a rubber mat used to fabricate a concrete lid in accordance with one embodiment of the present invention.

The fabrication of lid 310 will now be described in accordance with one embodiment of the present invention. FIG. 7 is an isometric view of a mold 700 used to fabricate lid 310. According to one embodiment of the invention, mold 700 is formed from a resilient material such as natural or synthetic rubber. Mold 700 includes the features to be cast into the top surface 312 of lid 310, including texturing 328 and nomenclature 330.

Mold 700 includes a base region 701 having a thickness in the range of about ¼ inch to ½ inch. A raised ring 702 extends upward from base region 701 to a height in the range of about ½ inch to 1 inch. Raised ring 702 is sized to snugly receive the upper edge 323 of reinforcing ring structure 320. Thus, in the described embodiment, raised ring 702 has an inside diameter of about 8.9 inches.

A reverse-image pattern 703 (which is the inverse of the texture 328) is also formed on the upper surface of base region 701, as illustrated. Reverse-image nomenclature 704 is also formed on the upper surface of base region 701, as illustrated. As will become apparent in view of the following disclosure, reverse-image pattern 703 and reverse-image nomenclature 704 form the texture 328 and nomenclature 330 on top surface 312 of lid 310.

Projecting conical fingers 705-706 also extend upward from the upper surface of mold 700. As will become apparent in view of the following disclosure, these fingers 705-706 are used to form lift holes 318-319. The tapered configuration of fingers 705-706 facilitates the removal of mold 700 from concrete core 311.

Figure 8A:
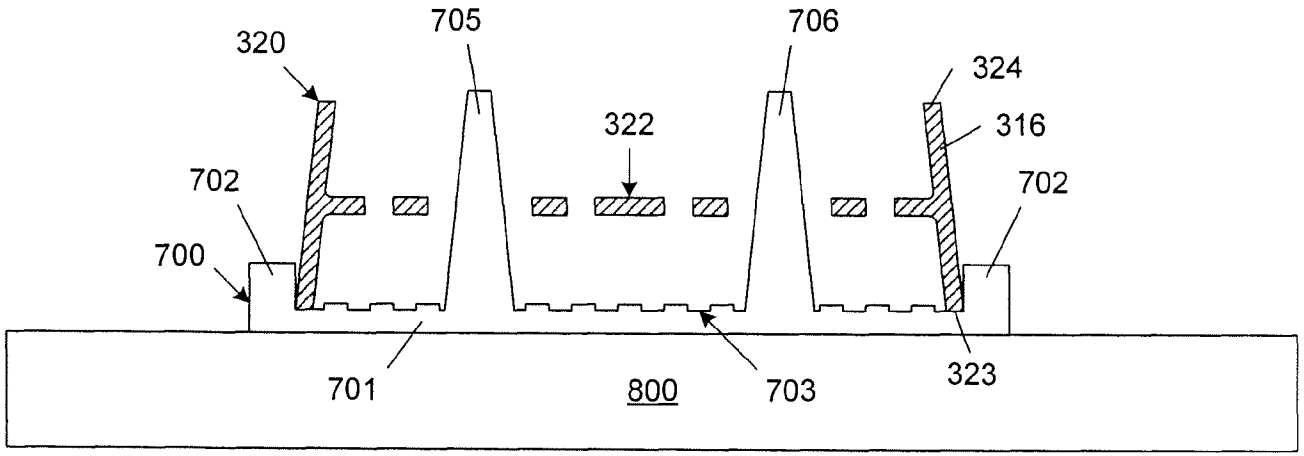
FIGS. 8A and 8B are cross sectional views of the concrete lid of FIG. 3 during various stages of fabrication.

FIG. 8A is a cross sectional view of ring structure 320 engaged with mold 700. Mold 700 is placed on a platform 800, with the upper surface of mold 700 facing upward. Ring structure 320 is then fitted into the raised ring 701 of mold 700, with the top edge 323 of ring structure 320 pointed downward. The fit between ring structure 320 and raised ring 701 of mold 700 is sufficiently tight to allow wet concrete to be contained, without any additional support structures. Note that fingers 705-706 extend through openings of reinforcement grid 322, and entirely through ring structure 320.

Figure 8B:
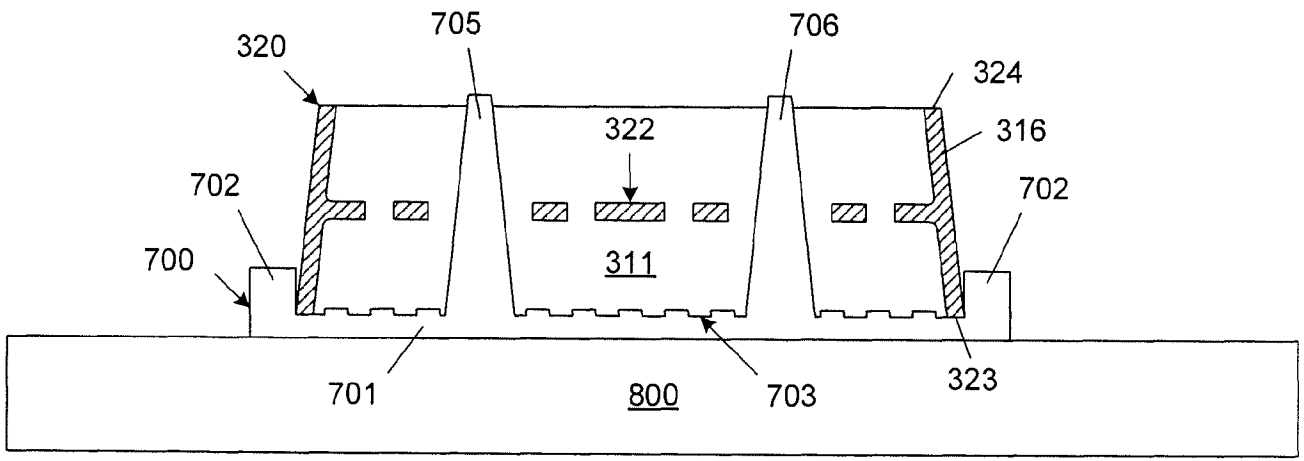

As illustrated in FIG. 8B, wet concrete or other mix, generally including cement, is then poured into ring structure 320 to a level approaching lower edge 324. In the described embodiment, a 5000# psi concrete mix is used. When the mix is sufficiently cured (thereby forming concrete core 311), mold 700 is separated from ring structure 320 and concrete core 311. This separation can be implemented by pulling on the mold 700 by hand. Alternately, mechanical means can be used to pull mold 700 from ring structure 320 and concrete core 311. The flexibility of mold 700 simplifies removal of mold 700 from lid 310. Due to its resilient nature, mold 700 can be easily removed from lid 310 after concrete core 311 is cured. In some embodiments, the curing period is accelerated by heating, as with steam or another heat source, to shorten the curing period, and to permit faster turnaround and reuse of mold 700. The curing period can also be accelerated by mixing an additive into the wet concrete. After the removal of mold 700, lid 310 may be warehoused for a period sufficient to fully cure the concrete, before installation in an in-ground utilities box.

The inventive lid 310 is superior to previously known lids in several respects. First, the manufacturing process is simplified. In forming solid concrete closures according to known art, a separate form for the sides is required (e.g., aluminum dryer 101). The form must be removable from the mold in order to release the closure from the mold, since the closure is formed top down to facilitate molding of the top face, and thus, the taper of the closure requires that the form for the sides be separated from the mold. The incorporation of plastic ring structure 320 eliminates that step from the process, and also eliminates the form itself. Any part used in the forming process must be cleaned between uses, so the cleaning of the form is also eliminated.

Lids manufactured according to known methods require reinforcement of the concrete, in the form of rebar or heavy gauge wire. Such reinforcement must be fixed in place before pouring the concrete into the form, or else the rebar will sink to the bottom of the form (see, reinforcing structure 105). The inventive method eliminates the added material as well as the manufacturing step. The reinforcement provided by plastic reinforcement grid 322 is also superior in strengthening characteristics than the traditional materials. Laboratory tests indicate significant improvement in strength and durability of the inventive lid 310 over known devices.

Warehousing is simplified, inasmuch as ring structure 320 has a standard width, making stacking of the finished parts simpler. Previously, slight variations in thickness of the closures, due to a difference in the amount of concrete used in the manufacturing process, would create significant difficulties in forming stable stacks. Use of the plastic ring structure 320 resolves the stacking problem and further simplifies the manufacturing process by reducing the need to precisely control the amount of concrete used. Furthermore, damage and loss of inventory caused in storage, as parts are moved and stacked on one another, is reduced, due to the improved tolerance to impacts afforded by plastic ring structure 320.

The shape of lid 310 is not limited to the shape discussed in the previous embodiment, and ring structure 320 is not limited to a tapering edge. The inventive principles may be applied to a wide range of boxes, vaults, and enclosures designed for underground use. Shapes include rectangular lids and lids having small openings located therein. Such small openings may be used to facilitate visual inspection of the contents of a box. In such applications, the plastic reinforcing member would further include one or more inner plastic sidewalls that define the small opening.

One variation of lid 310 will now be described.

Figure 9A:
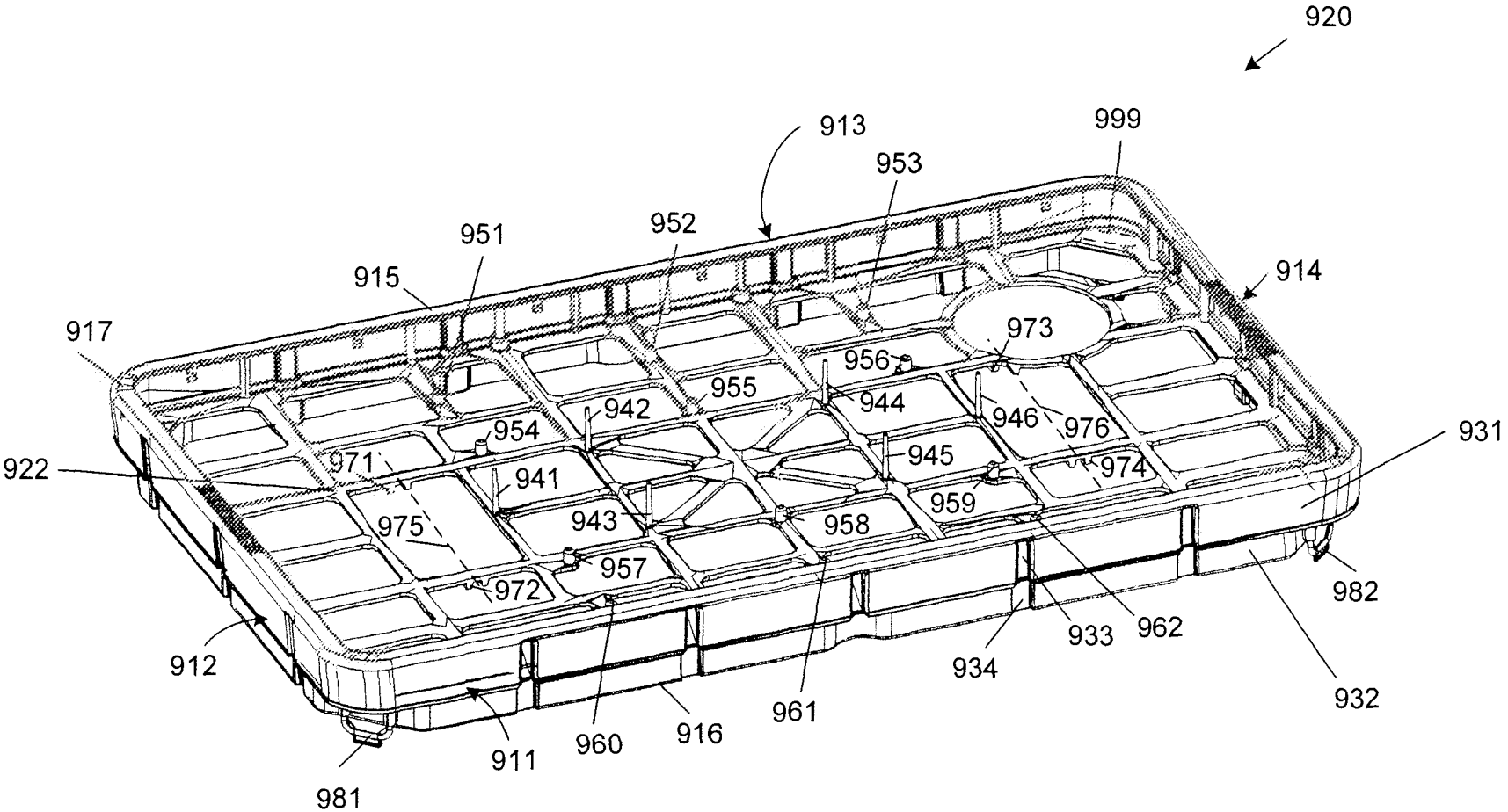
FIGS. 9A and 9B are top and bottom isometric views, respectively, of a plastic rectangular reinforcing structure in accordance with an alternate embodiment of the present invention.
Figure 9B:
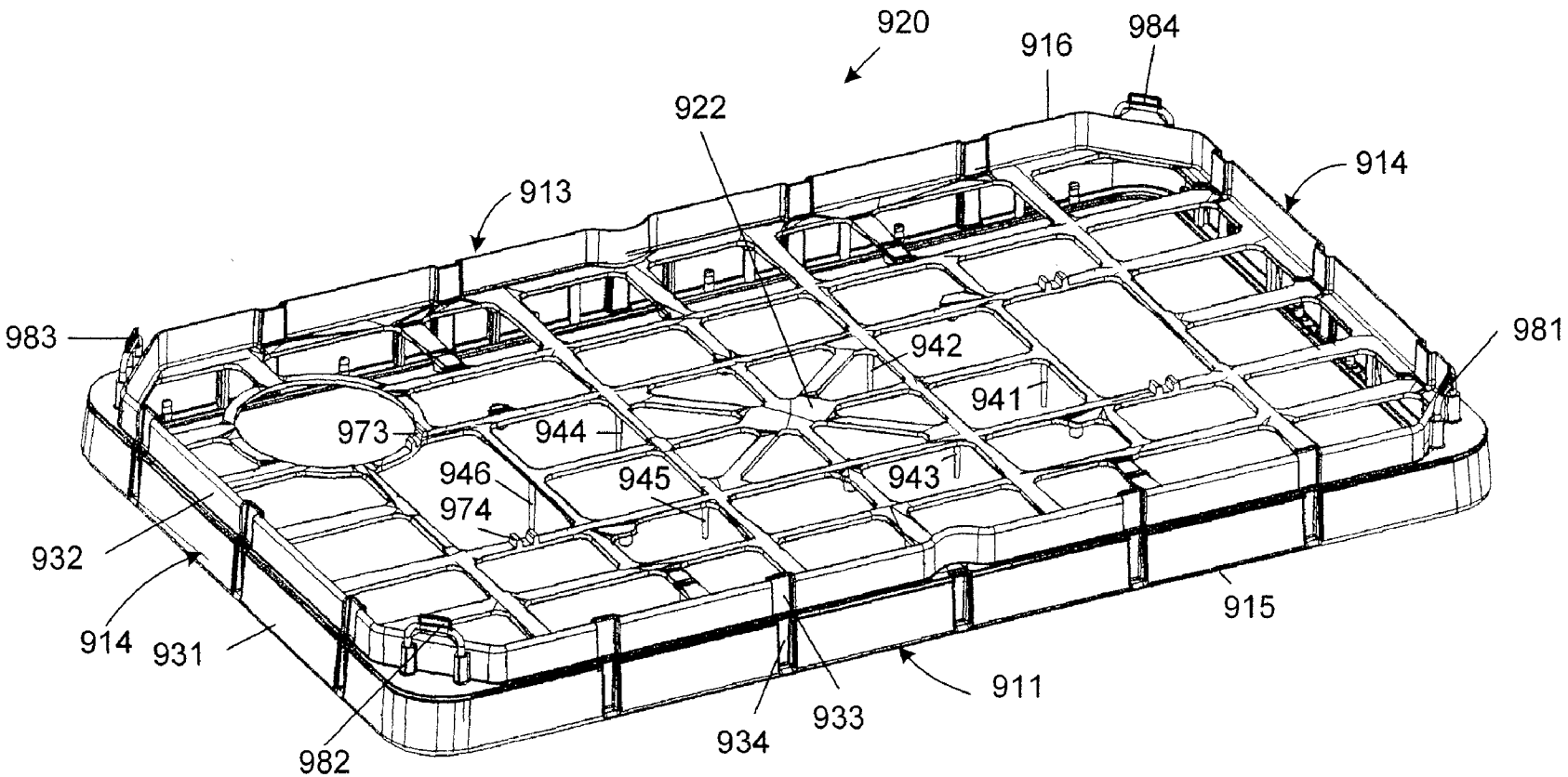

FIG. 9A is a top isometric view of a plastic rectangular reinforcing structure 920 in accordance with an alternate embodiment of the present invention. FIG. 9B is a bottom isometric view of rectangular structure 920. Rectangular structure 920 has a rectangular shape with curved corners. As described in more detail below, rectangular structure 920 is filled with a concrete core in the same manner as ring structure 320, thereby forming a rectangular lid. In the described embodiment, rectangular structure 920 is about 23¼ inches long, 13½ inches wide, and 2 inches deep. However, other dimensions are possible in other embodiments.

Rectangular structure 920 includes four circumscribing sidewalls 911-914, which exhibit an upper edge 915 and a lower edge 916. The upper edge 915 includes a rolled edge 917, which adds strength to rectangular structure. This rolled edge 917 helps to prevent distortion of rectangular structure 920 when wet concrete is poured into this structure. In the described embodiment, sidewalls 911-914 include a series of gussets, such as gussets 933-934. These gussets also contribute to the overall strength of rectangular structure 920. More specifically, these gussets help to prevent the lateral deflection of sidewalls 911-914 when wet concrete is poured into rectangular structure 920. Although a particular gusset configuration is shown, it is understood that other configurations are possible.

Rectangular structure 920 also includes a reinforcement grid 922, which extends between the sidewalls 911-914, and is centrally located between the upper and lower edges 915-916. Like reinforcement grid 322 (FIG. 5), reinforcement grid 922 includes a lattice of reinforcing members having openings that allow the passage of wet concrete. Reinforcement grid 922 provides reinforcement to the resulting lid in the same manner as reinforcement grid 322.

In addition, reinforcement grid 922 includes support struts 941-946, which extend straight up from reinforcement grid 922 in the direction of upper edge 915. The tips of support struts 941-946 are substantially level with the plane of upper edge 915. As will become apparent in view of the following disclosure, these support struts 941-946 maintain the position of reinforcement grid 922 (i.e., prevent reinforcement grid 922 from being deformed) while the wet concrete is being poured into rectangular structure 920.

Reinforcement grid 922 also includes female connector elements 951-962, which are located at predetermined locations on the upper surface of reinforcement grid 922. Connector elements 951-962 are located to receive nameplate-mounting structures (not shown), which receive nameplates (not shown) that identify the resulting lid. These nameplates can include inscriptions such as those identifying the type of utility housed in the associated box (e.g., sewer), or identifying the city in which the associated box is located. Connector elements 951-956 are located to receive a first nameplate mounting structure, and connector elements 957-962 are configured to receive a second nameplate mounting structure. In one embodiment, these nameplate-mounting structures are made of the same plastic material as rectangular structure 920. Such nameplate mounting structures are described in more detail below.

Reinforcement grid 922 also includes lift-rod connector elements 971-974, which are located on the underside of reinforcement grid 922. A first lift-rod can be snapped into lift-rod connector elements 971-972, as illustrated by dashed line 975, and a second lift-rod 976 can be snapped into lift-rod connector elements 973-974, as illustrated by dashed line 976. These lift-rods are typically metal. As described in more detail below, these lift-rods are subsequently exposed from the upper surface of the concrete core, thereby enabling these lift-rods to be used to lift the resulting lid.

Rectangular structure 920 also includes removable stacking pins 981-984, which facilitate the stacking of multiple rectangular structures in an efficient manner. These stacking pins 981-984 can be separate elements, which are inserted into rectangular structure 920, or can be integrally formed with rectangular structure 920. Either way, stacking pins 981-984 are removed from rectangular structure 920 prior to the actual use of the associated concrete lid. Stacking pins 981-984 are described in more detail below.

In the described embodiment, rectangular structure 920 has a 2-piece construction that includes an upper rectangular element 931 and a lower rectangular element 932. Other constructions are possible in other embodiments. A 2-piece construction was selected because it is easier to manufacture rectangular structure 920 in two pieces than in one piece. Both upper rectangular element 931 and lower rectangular element 932 are slightly tapered from upper edge 915 to lower edge 916, thereby facilitating removal and replacement of the finished lid in a corresponding utilities box.

Figure 10A:
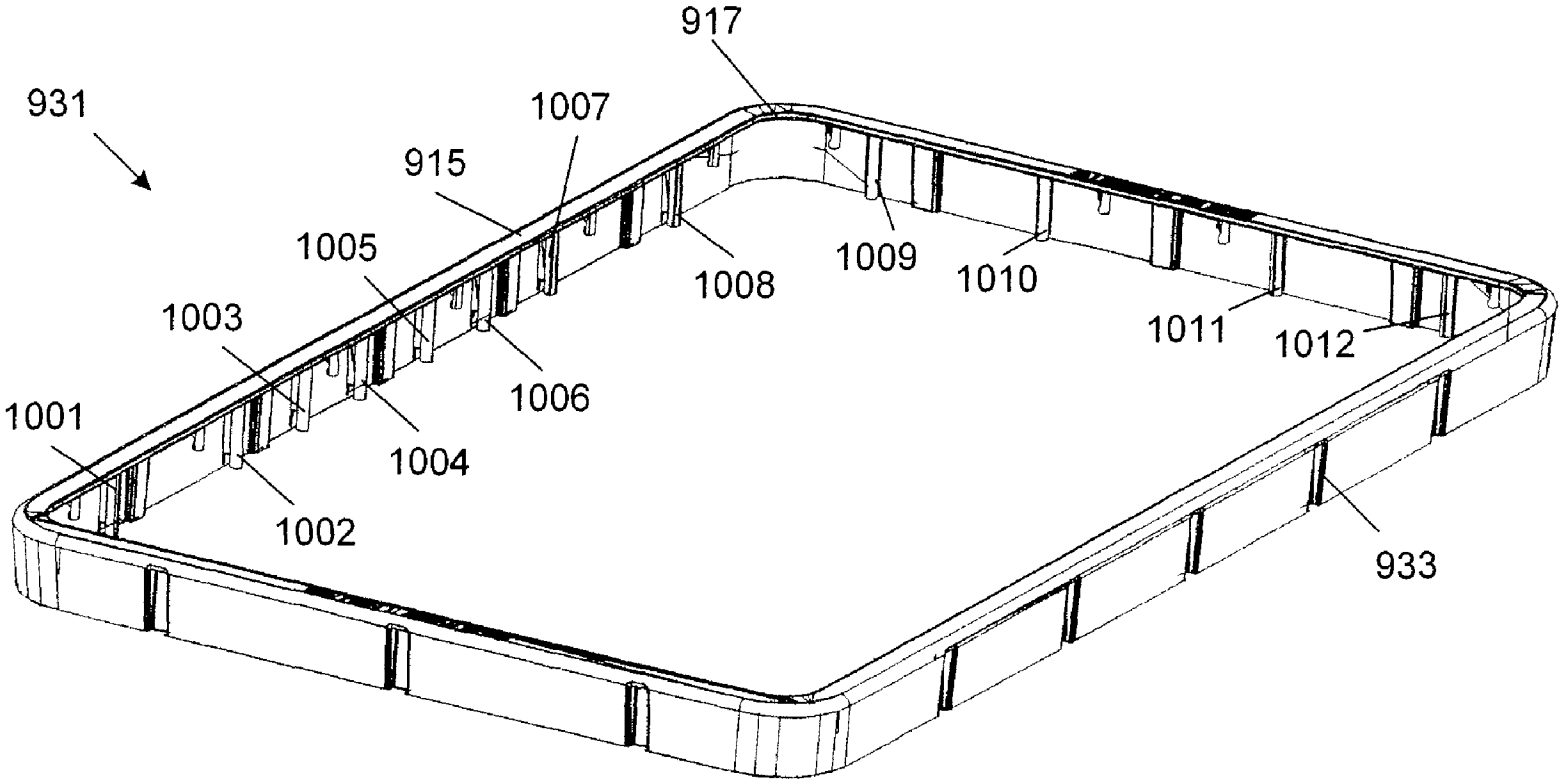
FIGS. 10A and 10B are top and bottom isometric views, respectively, of an upper rectangular element used to form the rectangular reinforcement structure of FIGS. 9A and 9B, in accordance with one embodiment of the present invention.
Figure 10B:
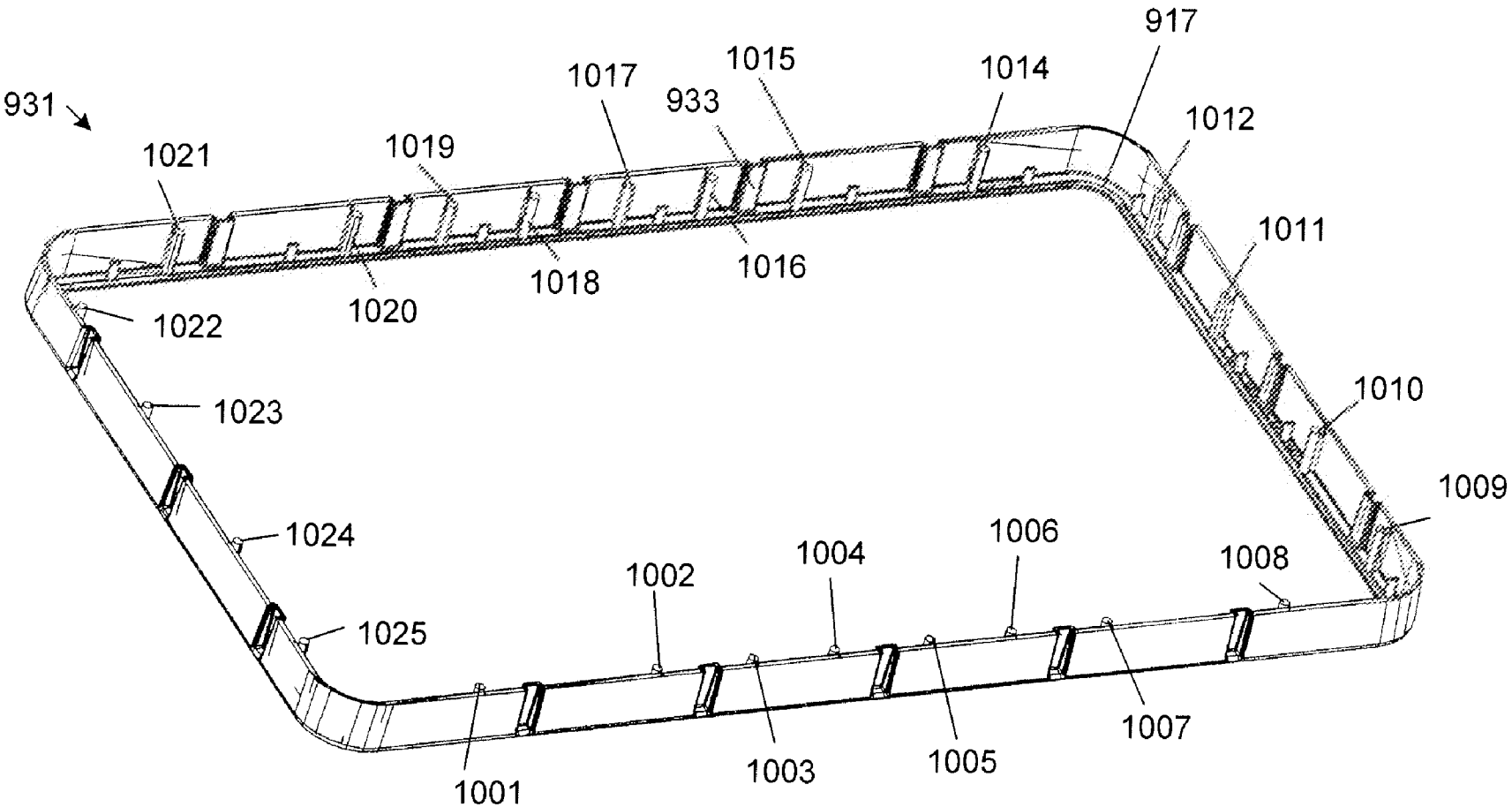

FIGS. 10A and 10B are top and bottom isometric views, respectively, of upper rectangular element 931 in accordance with one embodiment of the present invention. FIGS. 10A and 10B provide clearer views of the gussets (e.g. gusset 933) and the rolled edge 917. FIG. 10B also illustrates the male connector/spacer elements 1001-1025 used to join upper rectangular element 931 to lower rectangular element 932. In the present embodiment, upper rectangular element is injection-molded polypropylene, preferably with an ultraviolet inhibitor to retard damage due to sunlight. Other plastics having similar characteristics can be used in other embodiments. Upper rectangular element 931 has a width of about 13¼ inches, a length of about 23¼ inches and a height of about 1 inch.

Figure 11A:
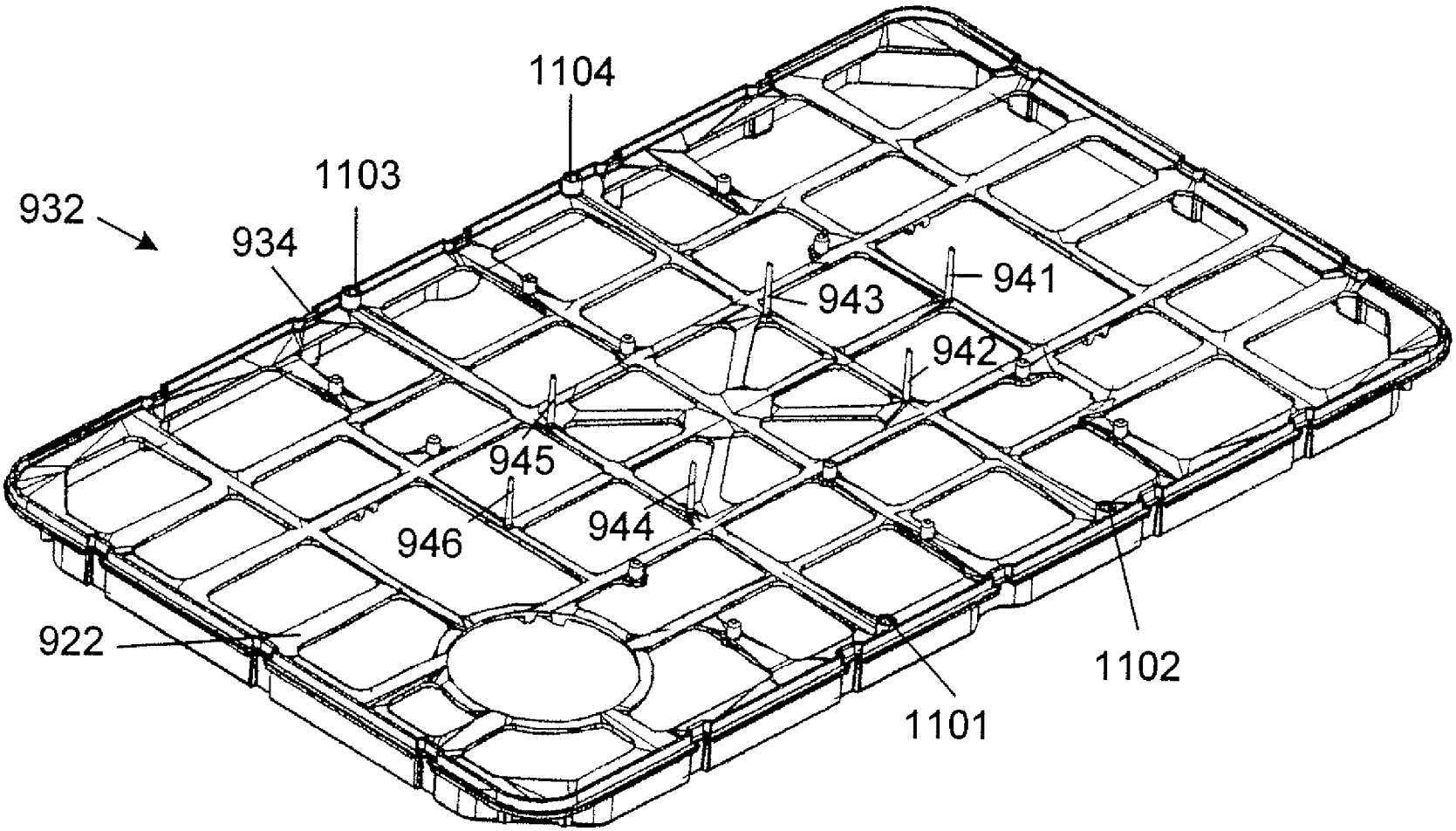
FIGS. 11A and 11B are top and bottom isometric views, respectively, of a lower rectangular element used to form the rectangular reinforcement structure of FIGS. 9A and 9B, in accordance with one embodiment of the present invention.
Figure 11B:
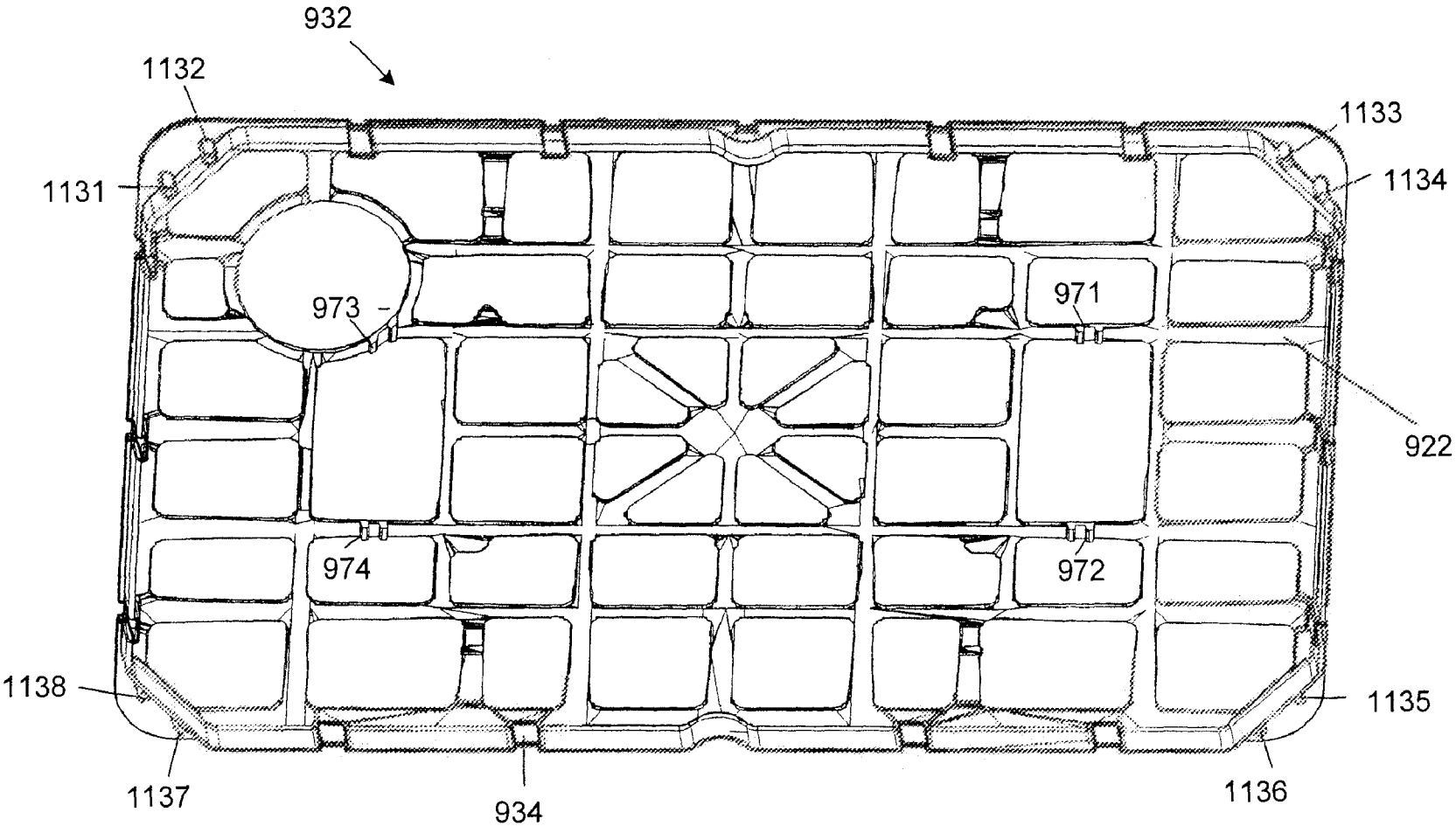

FIGS. 11A and 11B are top and bottom isometric views, respectively, of lower rectangular element 932 in accordance with one embodiment of the present invention. FIGS. 11A and 11B provide clearer views of the gussets (e.g., gusset 934). FIG. 11A also illustrates the female connector elements 1101-1104, which receive the associated male connector elements 1006, 1003, 1016, and 1019, respectively, of upper rectangular element 931. An adhesive can be used to hold these connector elements together. The tips of the remaining male spacer elements 1001-1002, 1004-1005, 1007-1015, 1017-1018 and 1020-1025 of upper rectangular element 931 rest on the upper surface of lower rectangular element 932, thereby ensuring proper seating between the two elements 931-932. FIG. 11B also provides a clearer view of lift-rod connector elements 971-974, and illustrates female connector elements 1131-1138 for receiving stacking pins 981-984. In the described embodiment, lower rectangular element 932 has a width of about 13¼ inches, a length of about 23¼ inches and a height of about 1 inch.

In the present embodiment, lower rectangular element 932 is injection-molded polypropylene, preferably with an ultraviolet inhibitor to retard damage due to sunlight. Other plastics having similar characteristics can be used in other embodiments. It is desirable for upper rectangular element 931 and lower rectangular element 932 to be made of the same material.

Figure 12:
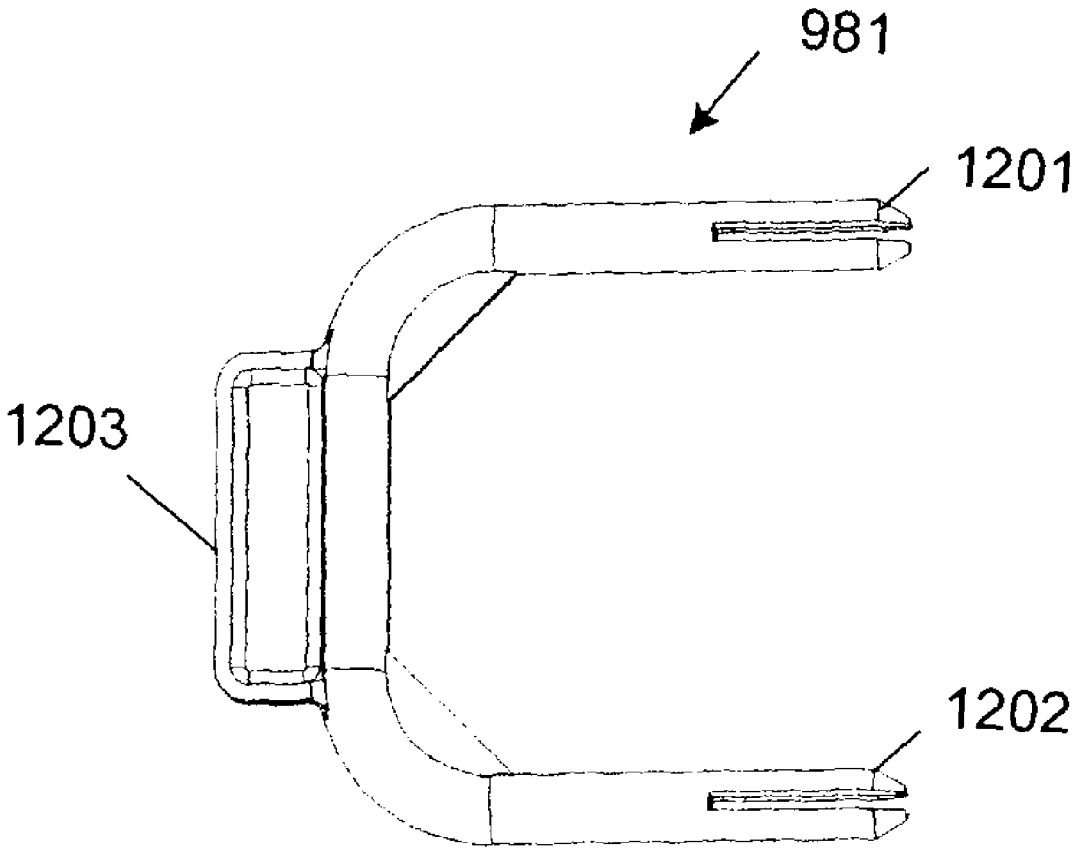
FIG. 12 is an isometric view of a stacking pin, which can be used to stack a plurality of rectangular reinforcement structures in accordance with one embodiment of the present invention.

FIG. 12 is an isometric view of an exemplary stacking pin 981, which includes male connector elements 1201-1202. These connector elements 1201-1202 are configured to fit into an associated pair of female connector elements (e.g., connector elements 1131-1132) in lower rectangular element 932. Stacking pin 981 has a flat lower surface 1203. When a first rectangular structure is stacked on top of a second rectangular structure, the flat lower surfaces (e.g., surface 1203) of the stacking pins of the first rectangular structure rest on the upper surface of the lower rectangular element of the second rectangular structure. FIG. 9A illustrates a location 999, where the flat lower surface of a stacking pin of an overlying rectangular structure would rest while the rectangular structures are being stored prior to adding the concrete cores. Note that the stacking pins extend through the upper rectangular structures in this configuration. The flat lower surfaces 1203 are co-planar with the bottom surface of the lower rectangular element 932. Stacking pins 981-984 thereby allow rectangular structures 920 to be stacked on top of one another in an efficient manner. Stacking pins 981-984 ensure that the weight of the stacked rectangular structures is evenly distributed, such that the stacked rectangular structures do not warp. Stacking pins 981-984 are removed prior to pouring the wet concrete core into rectangular structure 920.

Figure 13A:
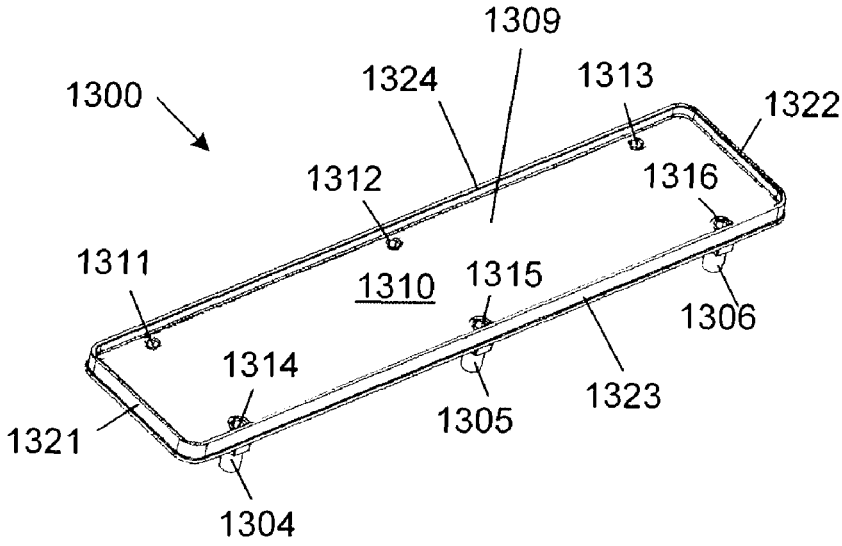
FIGS. 13A and 13B are top and bottom isometric views, respectively, of a nameplate mounting structure, which is used with the rectangular reinforcement structure of FIGS. 9A and 9B in accordance with one embodiment of the present invention.
Figure 13B:
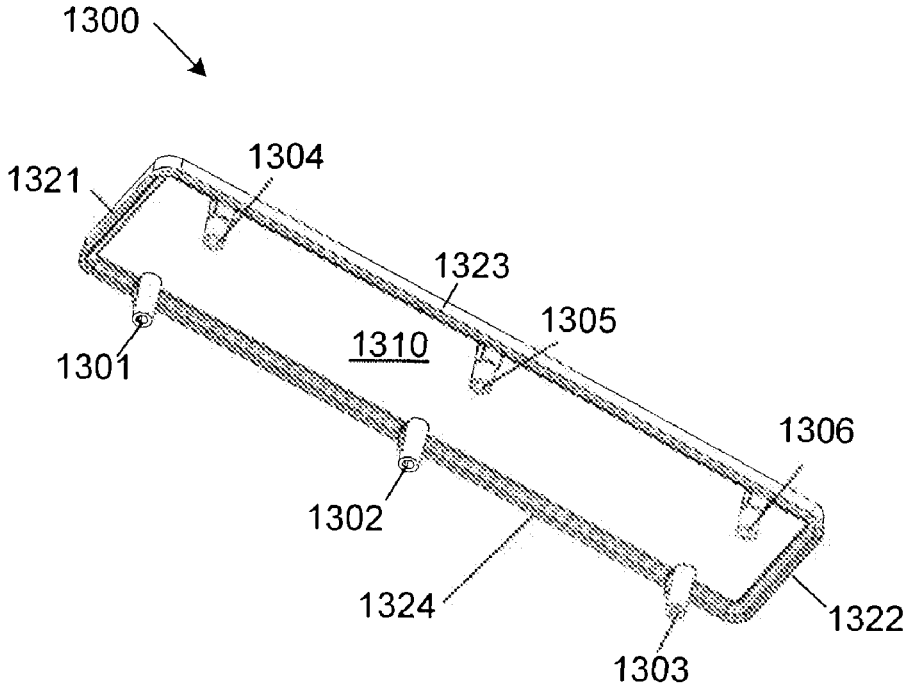

FIGS. 13A and 13B are top and bottom isometric diagrams, respectively, illustrating a nameplate mounting structure 1300, which is used with rectangular structure 920 in accordance with one embodiment of the present invention. Mounting structure 1300 includes male connector elements 1301-1306, female connector elements 1311-1316 and a flat platform 1310 having surrounding sidewalls 1321-1324 that define a cavity 1309. In the described embodiment, mounting structure 1300 is made of a plastic, such as polypropylene. In a preferred embodiment, mounting structure 1300 is made of the same material as rectangular structure 920. Male connector elements 1301-1306 are positioned to engage with corresponding female connector elements 951-956 (or female connector elements 957-962) on rectangular structure 920. The height of nameplate mounting structure 1300 is selected such that the upper surfaces of sidewalls 1321-1324 are substantially co-planar with or slightly below the plane of the upper edge 915 of rectangular structure 920. As described in more detail below, this configuration causes the upper surfaces of sidewalls 1321-1324 to be substantially flush with an upper surface of the resulting concrete lid.

Figure 14A:
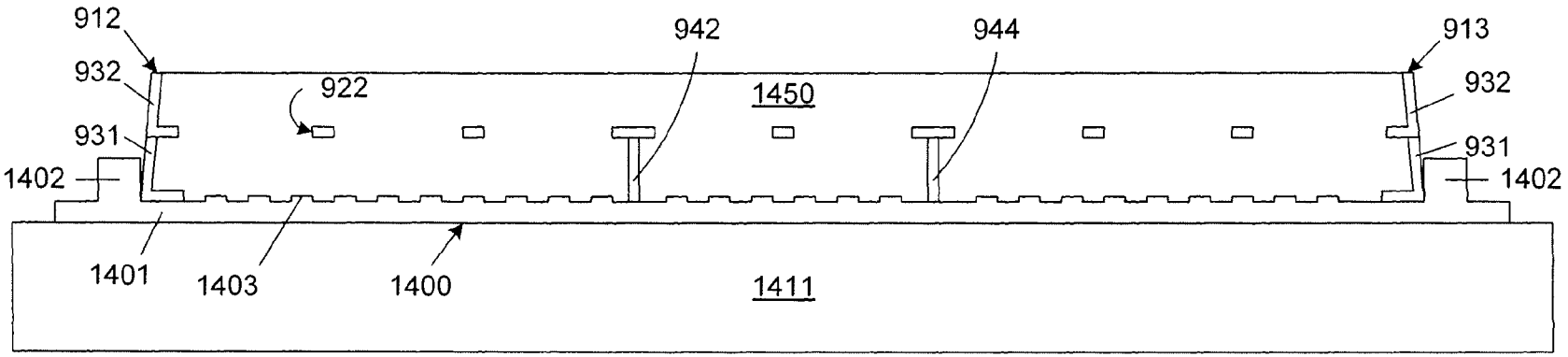
FIGS. 14A-14C are cross sectional diagrams illustrating the rectangular reinforcement structure of FIGS. 9A and 9B inserted into a corresponding mold.

After nameplate mounting structure 1300 has been inserted into connector elements 951-956, (and an identical mounting structure has been inserted into connector elements 957-962, rectangular structure 920 is inverted and inserted into a mold. FIG. 14A is a cross sectional diagram illustrating rectangular structure 920 inserted into mold 1400. According to one embodiment of the invention, mold 1400 is formed from a resilient material such as natural or synthetic rubber. Mold 1400 is set on platform 1411 as illustrated. Mold 1400 includes a base region 1401 and a raised rectangular region 1402 that extends upward from base region 1401 to a height in the range of about ¼ inch to about 1 inch. Raised rectangular region 1402 is sized to snugly receive the upper edge 915 of rectangular structure 920. A reverse-image pattern 1403 is also formed on the upper surface of base region 1401, as illustrated. Reverse-image pattern 1403 forms a texture on the top surface of the resulting concrete lid.

The cross sectional view of FIG. 14A passes through support struts 942 and 944, as illustrated. The tips of support struts 942 and 944 (and support struts 941, 943, and 945-946) contact mold 1400, thereby supporting reinforcement grid 922. After rectangular structure 920 has been inserted into mold 1400, wet concrete 1450 is poured into rectangular structure 920, as illustrated. Support struts 941-946 prevent the weight of the wet concrete from deforming (i.e., pushing down) reinforcement grid 922. As a result, reinforcement grid 922 remains centrally located within rectangular structure 920. While the present embodiment illustrates six support struts, other numbers (and positioning) of support struts can be used in other embodiments.

Figure 14B:
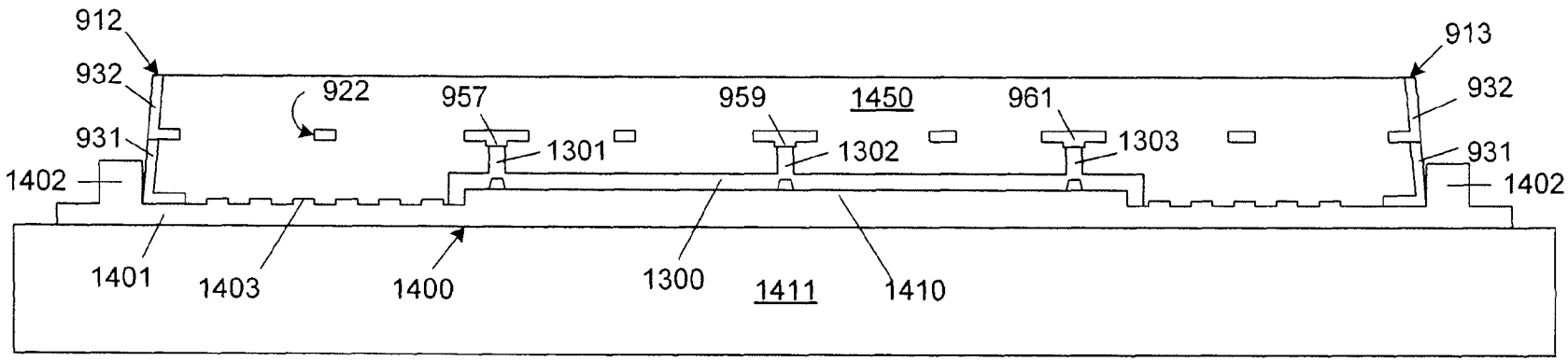

FIG. 14B is another cross sectional diagram illustrating rectangular structure 920 inserted into mold 1400. The cross sectional view of FIG. 14B passes through female connector elements 957, 959 and 961 and nameplate mounting structure 1300. Mold 1400 includes a raised rectangular section 1410, which is sized to snugly fit within cavity 1309 of nameplate mounting structure 1300. The upper surface of raised rectangular section 1410 rests on the flat surface 1310 of mounting structure 1300. As a result, raised rectangular section 1410 prevents the wet concrete 1450 from entering the cavity 1309 of nameplate mounting structure 1300. Note that mold 1400 includes another raised rectangular section (not shown) similar to raised rectangular section 1410, and corresponding with another nameplate mounting structure (not shown) fitted into connector elements 951-956.

Figure 14C:
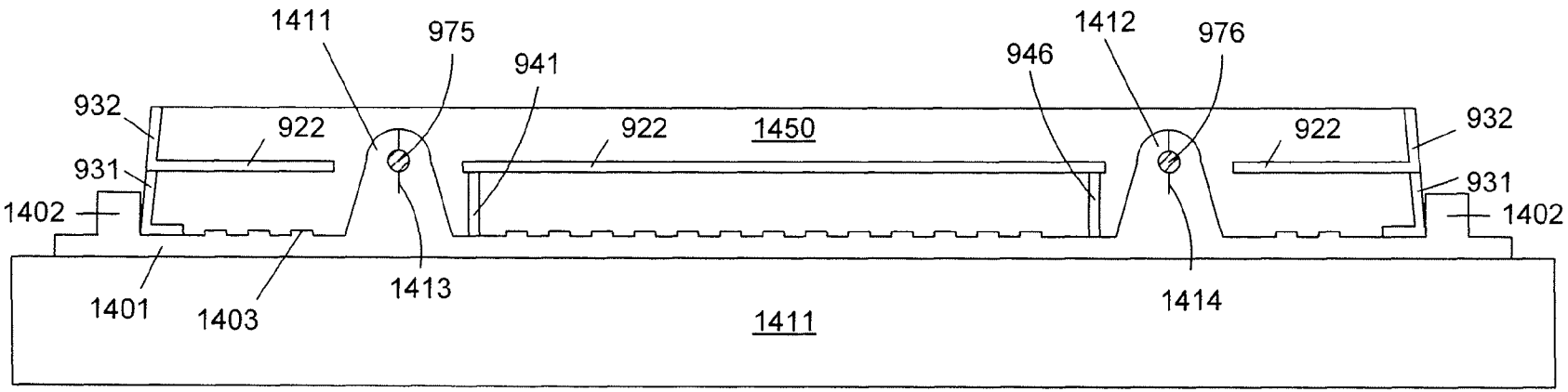

FIG. 14C is another cross sectional diagram illustrating rectangular structure 920 inserted into mold 1400. The cross sectional view of FIG. 14C passes through support struts 941 and 946, and a pair of lift rods 975-976 inserted into lift bar snaps 971-974. Mold 1400 includes raised structures 1411-1412, which are sized to engage lift rods 975-976, respectively. More specifically, lift rods 975-976 fit into slits 1413-1414, respectively, in raised structures 1411-1412. As a result, raised structures 1411-1412 prevent the concrete 1450 from reaching areas surrounding lift rods 975-976.

After the concrete core 1450 has had time to sufficiently cure, mold 1400 is removed from rectangular structure 920 and concrete core 1450. After mold 1400 has been removed, cavity 1309 in nameplate mounting structure 1300 is exposed at the upper surface of the resulting structure. At this time, a nameplate (which identifies the lid) can be inserted into nameplate mounting structure 1300.

Figure 15A:
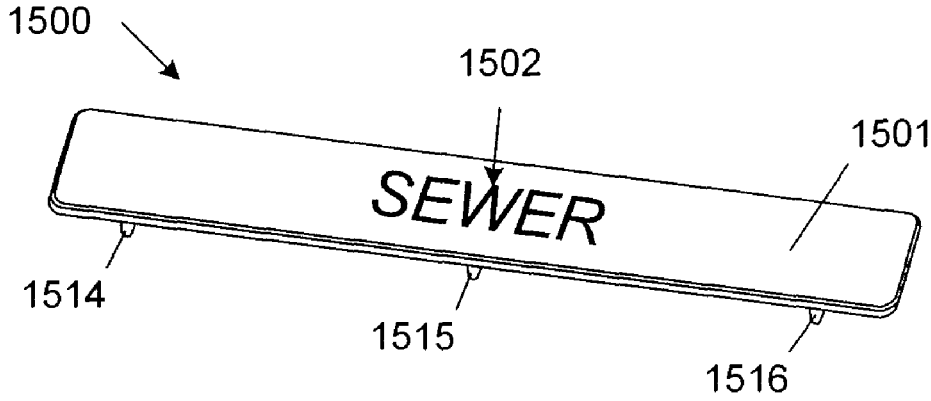
FIGS. 15A and 15B are top and bottom isometric views, respectively, of a nameplate in accordance with one embodiment of the present invention.
Figure 15B:
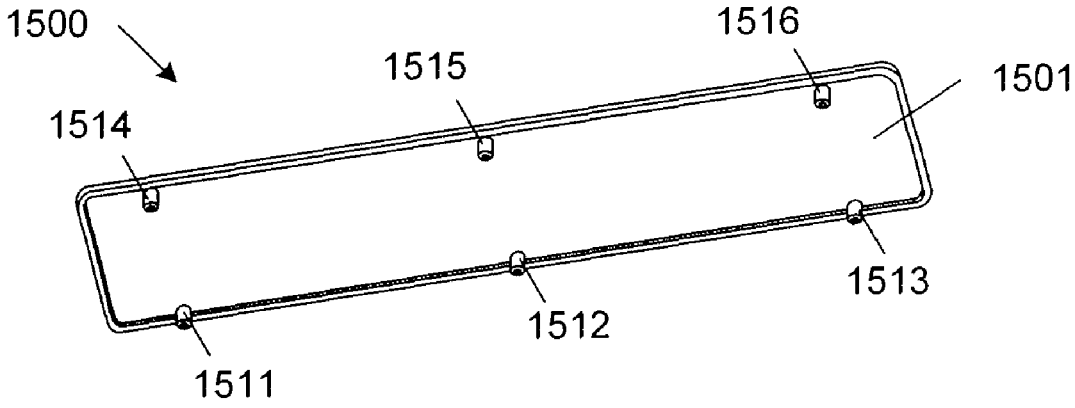

FIGS. 15A and 15B are top and bottom isometric views, respectively, of a nameplate 1500 in accordance with one embodiment of the present invention. Nameplate 1500 includes a platform 1501, nomenclature 1502 formed on an upper surface of platform 1501, and male connector elements 1511-1516 located on a lower surface of platform 1501. Nomenclature 1502 identifies the associated lid (e.g., as a "sewer" lid). Nomenclature 1502 can alternately include other information, such as the city in which the lid is to be located. In the described embodiment, nomenclature 1502 is formed in platform 501 by a molding process. However, other processes, such as engraving, etching or dying can be used to form nomenclature 1502. Male connector elements 1511-1516 are configured to engage with female connector elements 1311-1316 on the flat surface 1310 of nameplate mounting structure 1300. The thickness of platform 1501 is selected such that when the nameplate 1500 is fitted into nameplate mounting structure 1300, the upper surface of platform 1501 is flush with the upper surfaces of sidewalls 1321-1324. As a result, the upper surface of platform 1501 is flush with the upper surface of concrete core 1450. In the described example, platform 1501 has a thickness of about ¼ inch.

Figure 16:
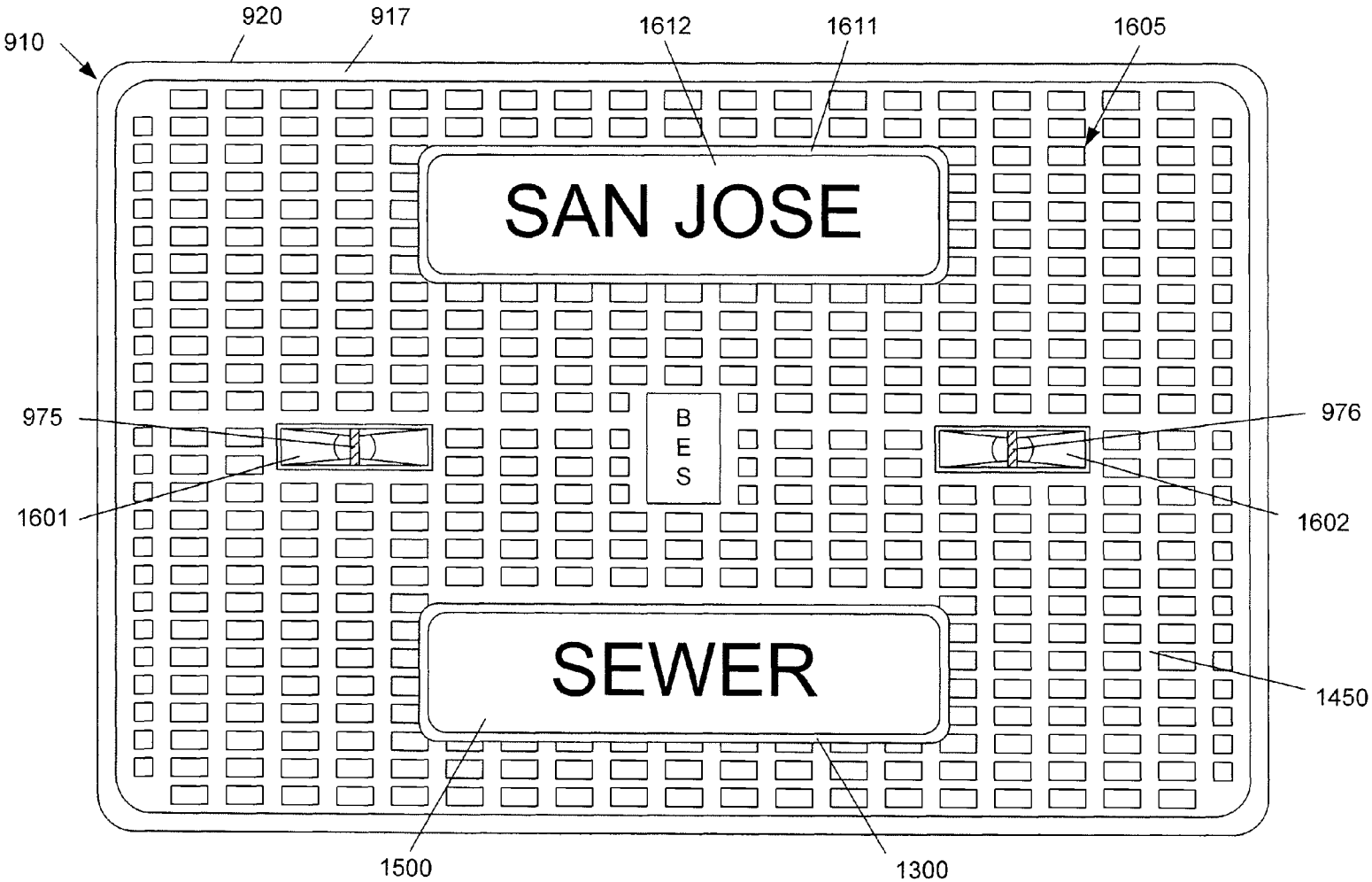
FIG. 16 is a top view of a rectangular concrete lid formed using the rectangular reinforcement structure of FIGS. 9A and 9B, in accordance with one embodiment of the present invention.

FIG. 16 is a top view of a rectangular concrete lid 910, which results from the above-described process. The upper surface of concrete core 1450 has a pattern 1605, which is introduced by mold 1400 in the manner described above. This pattern 1605 can include nomenclature that is common to all lids, such as the box including "BES", which identifies the manufacturer of lid 910. Cavities 1601 and 1602 are formed in the upper surface of concrete core 1450, in response to the raised structures 1411-1412 of mold 1400 (FIG. 14C). These cavities 1601-1602 expose portions of lift rods 975-976 as illustrated. As a result, lift rods 975-976 can be engaged by hook elements, thereby enabling lid 910 to be easily lifted by lift rods 975-976. Lift rods 975-976 are advantageously located at a precise height below the upper surface of lid 910, due to the positioning of lift rods 975-976 provided by reinforcement grid 922. Moreover, because lift rods 975-976 are positioned below reinforcement grid 922, this reinforcement grid prevents lift rods 975-976 from being pulled up out of concrete core 910. That is, when lid 910 is lifted by lift rods 975-976, these lift rods are supported by both concrete core 1450 and reinforcement grid 922. Thus, lift rods 975-976 are less susceptible to being pulled out of concrete lid 910 than prior art lift rods.

FIG. 16 also illustrates nameplate 1500 fitted into nameplate mounting structure 1300. In the described embodiment, nameplate 1500 indicates that lid 910 will cover a utility box that contains "sewer" devices. Lid 910 also includes another nameplate 1612 fitted into another nameplate mounting structure 1611. This nameplate 1612 indicates that lid 910 will cover a utility box located in "San Jose". The upper surface of concrete core 1450 is flush with the upper surfaces of nameplates 1500 and 1612. The fact that nameplate-mounting structures 1300 and 1611 are connected to reinforcement grid 922 enables the height of nameplates 1500 and 1612 to be precisely controlled.

The use of nameplates 1500 and 1612 make the manufacture of lid 910 more efficient. For example, in accordance with prior fabrication techniques, a mold would have to include fixed patterns to form the nomenclature "sewer" and "San Jose" on a resulting concrete lid. A large inventory of molds would have to be maintained in order to create concrete lids for all of the different utilities for an entire city. Moreover, if concrete lids were to be created for a new city, a new set of molds would have to be created, specifically identifying that city.

In accordance with the present invention, the same reinforcement grid 922 can theoretically be used for all utilities and all cities. Different nameplates can be created to identify the different utilities and different cities. Advantageously, a manufacturer of concrete lids only needs to maintain an inventory of generic molds.

In accordance with another embodiment of the present invention, the nameplates and nameplate mounting structures (each having a fixed size) can be used in reinforcing structures having different sizes and shapes, thereby further increasing the efficiency of this labeling system.

In accordance with yet another embodiment of the present invention, nameplates, such as nameplates 1500 and 1612 can be fitted into non-concrete lids. For example, lids created from a material such as a composite resin may be compression molded to include recessed regions (and female connector elements) that are configured to receive nameplates 1500 and 1612.

Returning now to FIG. 16, the upper surface of rolled edge 917 is flush with the upper surface of concrete core 1450, such that the upper surface of lid 910 is substantially flat. Rolled edge 917 provides structural strength the resulting lid 910, and also prevents the upper edges of lid 910 from chipping. In addition to the above described advantages, concrete lid 910 also exhibits the advantages described above for concrete lid 310.

Figure 17A:
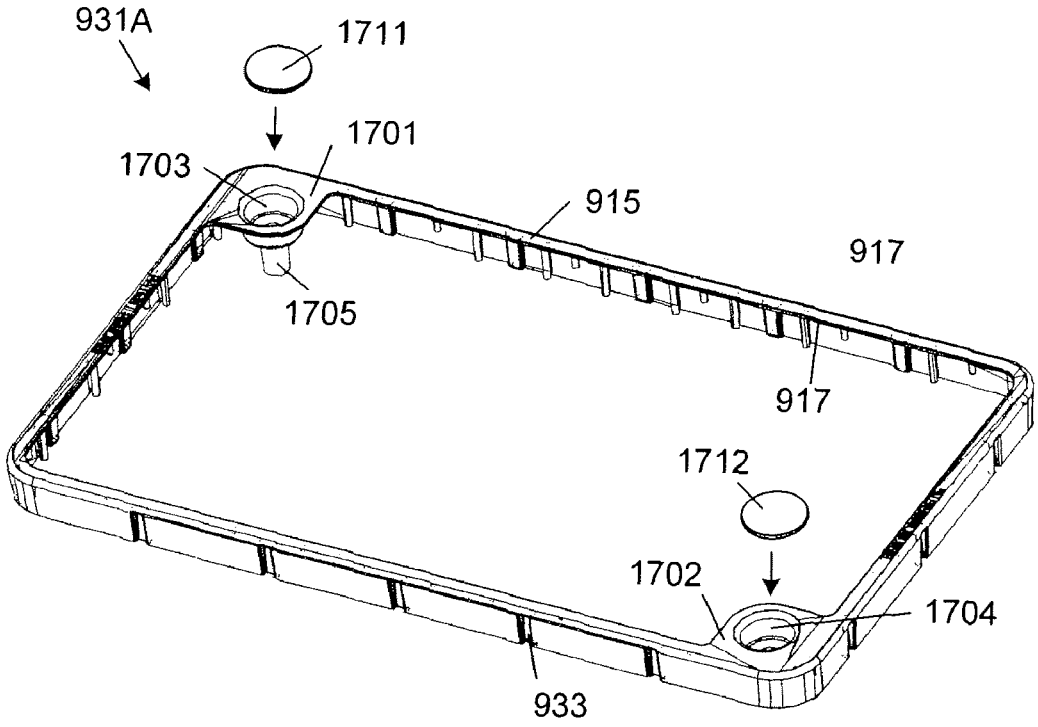
FIGS. 17A and 17B are upper and lower isometric views, respectively, of an upper rectangular element in accordance with one variation of the present invention.
Figure 17B:
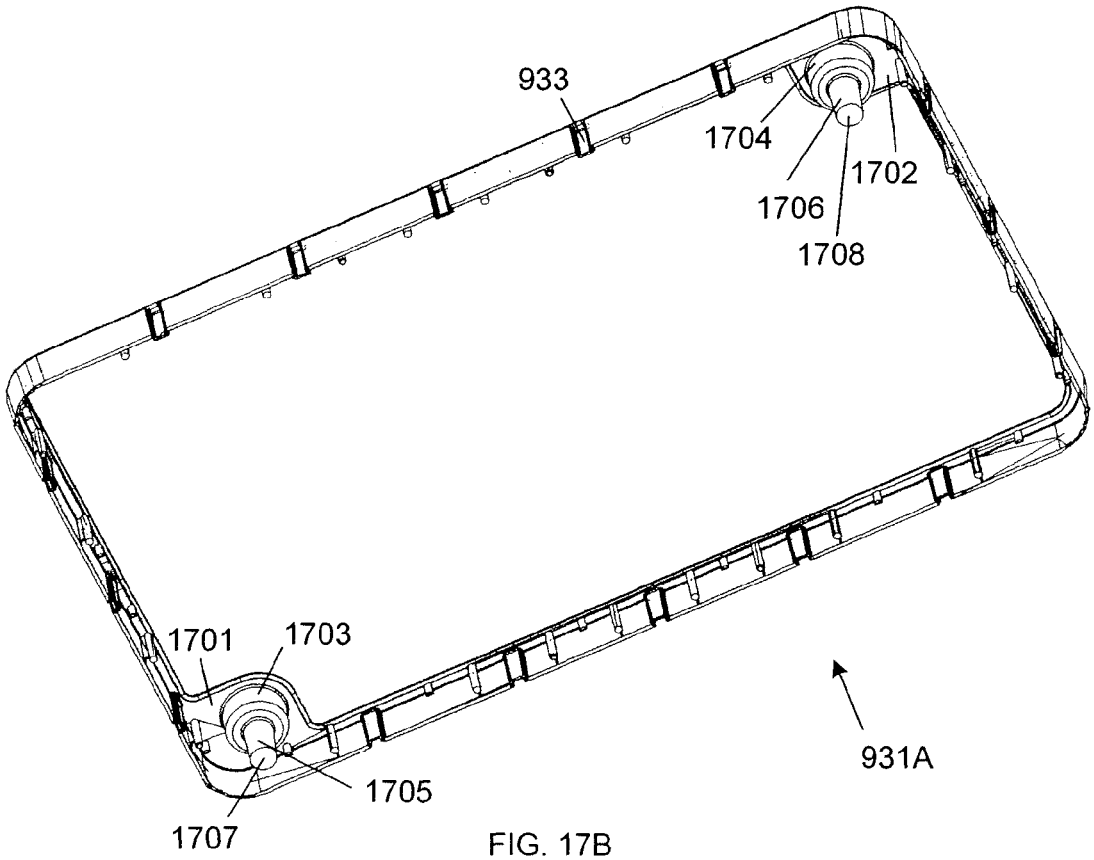

FIGS. 17A and 17B are upper and lower isometric views, respectively, of an upper rectangular element 931A in accordance with one variation of the present invention. Because upper rectangular element 931A is substantially identical to upper rectangular element 931 (FIGS. 10A-10B), similar elements in FIGS. 10A-10B and 17A-17B are labeled with similar reference numbers. Upper rectangular element 931A additionally includes edge extensions 1701-1702 at the upper left and lower right corners, respectively. These edge extensions 1701-1702 are co-planar with rolled edge 917, and provide additional reinforcement to the upper rectangular element 931A. First cylindrical sections 1703-1704 extend downward from centrally located positions in edge extensions 1701-1702, respectively. Second cylindrical sections 1705-1706 extend downward from the ends of first cylindrical sections 1703-1704, respectively. First cylindrical sections 1703-1704 are wider than second cylindrical sections 1705-1706. In one embodiment, first cylindrical sections 1703-1704 each have a diameter of about 1⅜ inches and a height of about ⅝ inches. In this embodiment, second cylindrical sections 1705-1706 each have a diameter of about ⅜ inches and a height of about 1⅛ inches. Thin membranes 1707-1708 are formed at the lower surfaces of second cylindrical sections 1705-1706. In one embodiment, these membranes 1707-1708 are paper-thin, having a thickness of about 1/32 to 1/64 inches. In one embodiment, small perforations, which follow a circular path, can be formed through the thin membranes 1707-1708. The heights of the first and second cylindrical sections are selected such that the thin membranes 1707-1708 are flush with the bottom edge of the rectangular reinforcement structure that results when upper rectangular element 931 is coupled to an associated lower rectangular element (e.g., lower rectangular element 932).

When concrete is poured into the rectangular reinforcement structure that includes upper rectangular element 931A, thin membranes 1707-1708 prevent concrete from entering the cylindrical sections 1703-1706. Concrete is poured to the level of thin membranes 1707-1708, such that these thin membranes are exposed at the bottom edge of the resulting lid.

The resulting lid can be used as a bolt-down lid or a non bolt-down lid. To use the resulting lid as a non bolt-down lid, plastic plugs 1711 and 1712 (FIG. 17A) are fitted into the exposed openings of first cylindrical sections 1703 and 1704. Plastic plugs 1711-1712 are dimensioned to snugly fit into first cylindrical sections 1703-1704. The upper surfaces of plastic plugs 1711-1712 are substantially co-planar with edge extensions 1701-1702.

To use the resulting lid as a bolt-down lid, membranes 1707-1708 are removed, for example, by a cylindrical punch. After membranes 1707-1708 are removed, J-bolts can be attached to cylindrical sections 1703-1706.

Figure 17C:
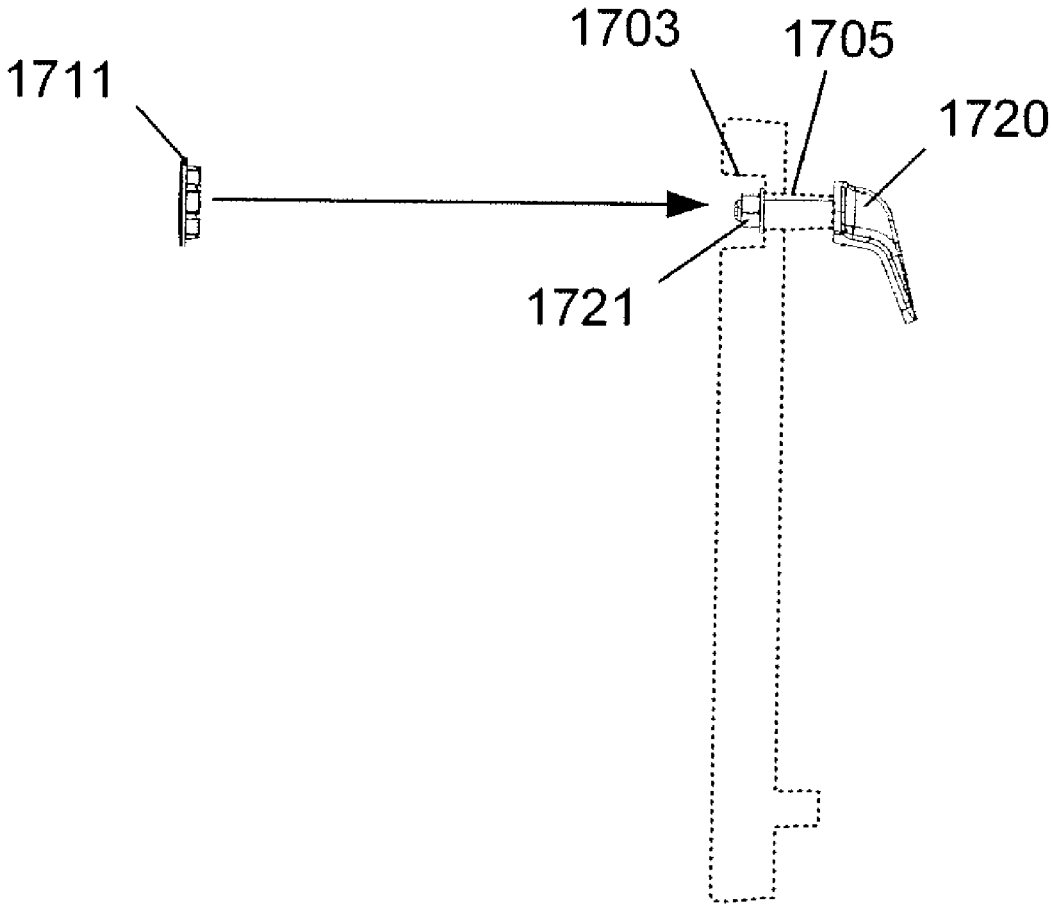
FIG. 17C is a side/cross-sectional view of a J-bolt, which is mounted on the upper rectangular element of FIGS. 17A and 17B in accordance with one embodiment of the present invention.

FIG. 17C is a side/cross-sectional view of a J-bolt 1720, which extends through cylindrical sections 1703 and 1705. An associated nut 1721 (and washer 1722) is attached to the end of J-bolt 1720, thereby attaching the J-bolt to upper rectangular structure 931A. J-bolt 1720 holds the resulting lid in an associated concrete box in a manner known to those of ordinary skill in the art. When the resulting lid is positioned in the associated concrete box (i.e., after J-bolt 1720 has been engaged with the concrete box), plastic plugs 1711 and 1712 are fitted into the exposed openings of first cylindrical sections 1703 and 1704.

Figure 18:
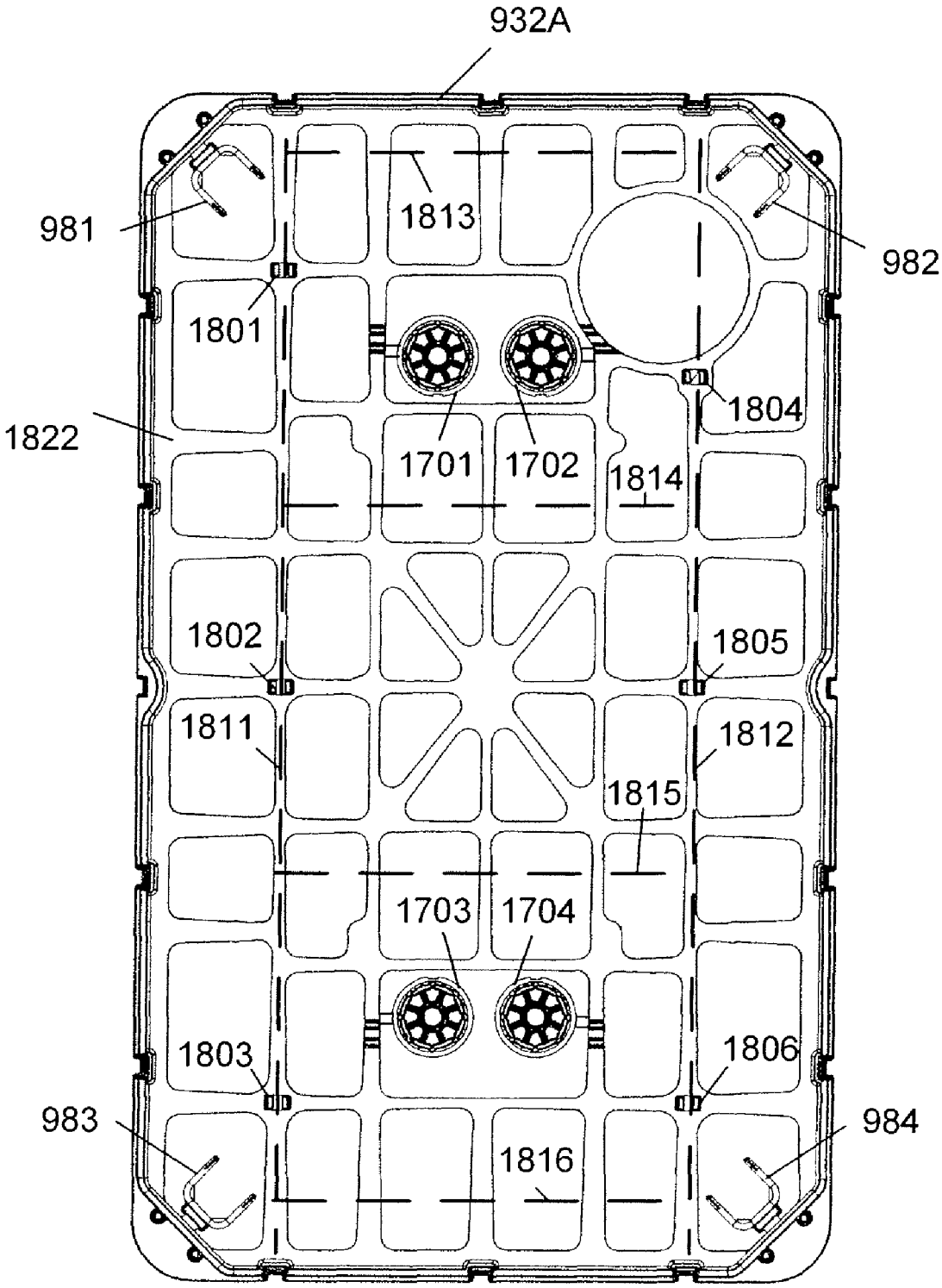
FIG. 18 is a bottom view of a lower rectangular element in accordance with one embodiment of the present invention.

In accordance with one embodiment, plastic plugs 1711-1712 can be fabricated as part of a lower rectangular element. FIG. 18 is a bottom view of a lower rectangular element 932A, which includes plastic plugs 1701-1704 and stacking pins 981-984. Plastic plugs 1701-1704 and stacking pins 981-984 are formed integrally with lower rectangular element 932A, as part of an injection molding process. These elements are snapped off of the lower rectangular element prior to pouring the concrete into the associated lid. As a result, these elements do not have to be fabricated separately.

Lower rectangular element 932A also includes reinforcement connector elements 1801-1806, which are similar to lift-rod connector elements 971-974. Reinforcement connector elements 1801-1806 can be formed at various locations on the plastic reinforcement grid 1822 of lower rectangular element 931A. Reinforcement connector elements 1801-1806 are located on the bottom surface of plastic reinforcement grid 1822. Reinforcement structures can be snapped into these reinforcement connector elements 1801-1806. As a result, the reinforcement structures are held in place against the plastic reinforcement grid 1822. In a particular embodiment, metal rods (illustrated by dashed lines 1811-1812) or a wire screen (illustrated by dashed lines 1811-1816) can be snapped into the reinforcement connector elements, thereby providing additional reinforcement to the resulting concrete lid. Although six reinforcement connector elements 1801-1806 are illustrated in the present example, it is understood that other numbers of reinforcement connector elements can be used in other embodiments. It is further understood that these reinforcement connector elements can be located at different locations on plastic reinforcement grid 1822. Moreover, although a specific pattern is defined by dashed lines 1811-1816, it is understood that other grid patterns can be used in other embodiments.

Although the invention has been described in connection with several embodiments, it is understood that this invention is not limited to the embodiments disclosed, but is capable of various modifications, which would be apparent to a person skilled in the art. For example, the male and female connector elements can be interchanged in other embodiments. Moreover, although concrete lids having certain shapes and dimensions have been described, it is understood that the invention applies to concrete lids having other shapes and dimension. In addition, while rolled edge 917, support struts 941-946, lift rods 975-976, nameplate mounting structure 1300 and nameplate 1500 were described in connection with a rectangular lid, it is understood that these elements can also be applied to lids having other shapes, such as round lid 310. Thus, the invention is limited only by the following claims.

We claim:

1. A method of forming a lid for a utilities box, the method comprising:

coupling a plastic reinforcing structure to a mold, wherein the plastic reinforcing structure includes one or more circumscribing plastic sidewalls, wherein a first edge of the one or more circumscribing plastic sidewalls engages the mold; then filling the plastic reinforcing structure with concrete, wherein the concrete is laterally contained by the one or more circumscribing plastic sidewalls of the plastic reinforcing structure;

curing the concrete, thereby creating cured concrete that bonds to the plastic reinforcing structure; and removing the mold from the plastic reinforcing structure and the cured concrete, thereby forming a lid that includes the cured concrete and the plastic reinforcing structure, wherein the one or more circumscribing plastic sidewalls form sidewalls of the lid.

2. The method of claim 1, further comprising forming a pattern in the concrete with the mold.

3. The method of claim 1, further comprising forming one or more lift holes in the concrete with the mold.

4. The method of claim 1, wherein the step of filling the plastic reinforcement structure comprises pouring wet concrete into the plastic reinforcement structure, wherein the wet concrete passes through openings in a plastic reinforcement grid that is integrally formed with, and centrally located within, the plastic reinforcement structure.

5. The method of claim 4, further comprising supporting the plastic reinforcement grid with one or more support struts that extend between the plastic reinforcement grid and the mold.

6. The method of claim 4, further comprising:

connecting one or more lift rods to the plastic reinforcement grid; and exposing portions of the one or more lift rods through the concrete using the mold.

7. The method of claim 6, further comprising positioning the one or more lift rods such that the plastic reinforcement grid is located between the lift rods and the mold.

8. The method of claim 1, further comprising coupling a nameplate mounting structure to the plastic reinforcement grid, wherein a first portion of the nameplate mounting structure contacts the mold, such that the concrete does not reach the first portion of the nameplate mounting structure.

9. The method of claim 3, further comprising attaching a nameplate to the first portion of the nameplate mounting structure, after removing the mold.

10. The method of claim 1, wherein the step of curing the concrete includes heating the concrete.

* * * * *